US010987928B2

(12) United States Patent
Tsukahara et al.

(10) Patent No.: US 10,987,928 B2
(45) Date of Patent: Apr. 27, 2021

(54) LIQUID EJECTING HEAD AND LIQUID EJECTING APPARATUS

(71) Applicant: SEIKO EPSON CORPORATION, Tokyo (JP)

(72) Inventors: Katsutomo Tsukahara, Shiojiri (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/472,781

(22) PCT Filed: Dec. 6, 2017

(86) PCT No.: PCT/JP2017/043810
§ 371 (c)(1),
(2) Date: Jun. 21, 2019

(87) PCT Pub. No.: WO2018/116833
PCT Pub. Date: Jun. 28, 2018

(65) Prior Publication Data

US 2019/0366714 A1 Dec. 5, 2019

(30) Foreign Application Priority Data

Dec. 22, 2016 (JP) ..... JP2016-249118
Apr. 10, 2017 (JP) ..... JP2017-077593

(51) Int. Cl.
*B41J 2/14* (2006.01)
*B41J 2/18* (2006.01)

(52) U.S. Cl.
CPC ..... *B41J 2/14* (2013.01); *B41J 2/14233* (2013.01); *B41J 2/18* (2013.01); *B41J 2002/14411* (2013.01)

(58) Field of Classification Search
CPC ..... B41J 2202/12; B41J 2/14233; B41J 2/14209; B41J 2002/14419; B41J 2/1433; B41J 2/18; B41J 2/175; B41J 2/14201; B41J 2002/14306; B41J 2002/14467; B41J 2002/14411; B41J 2/14
See application file for complete search history.

(56) References Cited

U.S. PATENT DOCUMENTS

2012/0176450 A1 7/2012 Akahane et al.

FOREIGN PATENT DOCUMENTS

| | | |
|---|---|---|
| JP | 2011051155 | 3/2011 |
| JP | 2012143948 | 8/2012 |
| JP | 2015134507 | 7/2015 |
| JP | 2016124146 | 7/2016 |
| JP | 2016147442 | 8/2016 |

*Primary Examiner* — Jannelle M Lebron
(74) *Attorney, Agent, or Firm* — Workman Nydegger

(57) ABSTRACT

A liquid in the vicinity of a nozzle is efficiently circulated. A liquid ejecting head includes: a nozzle plate provided with a first nozzle; a flow channel forming unit provided with a first pressure, a first communication channel through which the first nozzle and the first pressure chamber communicate with each other, and a circulating liquid chamber. The nozzle plate is provided with a first circulation channel through which the first communication channel and the circulating liquid chamber communicate with each other.

29 Claims, 12 Drawing Sheets

LIQUID EJECTING HEAD AND LIQUID EJECTING APPARATUS

CROSS REFERENCE TO RELATED APPLICATIONS

This application is a U.S. Nationalization of PCT Application Number PCT/JP2017/043810, filed on Dec. 6, 2017, which claims priority to JP Patent Application No. 2016-249118, filed Dec. 22, 2016, and JP Patent Application No. 2017-077593, filed Apr. 10, 2017, the entireties of which are incorporated herein by reference.

TECHNICAL FIELD

The present invention relates to a technology of ejecting a liquid such as ink.

BACKGROUND ART

In the related, there is proposed a liquid ejecting head that ejects a liquid such as ink from a plurality of nozzles. For example, PTL 1 discloses a liquid electing head having a stacking structure in which a flow channel forming substrate is disposed on a front surface of a communication plate on one side, and a nozzle plate is disposed on a front surface thereof on the other side. The flow channel forming substrate is provided with a pressure generating chamber that is filled with a liquid which is supplied from a common liquid chamber (reservoir), and the nozzle plate is provided with a nozzle. The pressure generating chamber and the nozzle communicate with each other via a communication channel formed in the communication plate. The front surface of the communication plate, on which the nozzle plate is disposed, is provided with a circulation flow channel, which communicates with the common liquid chamber, and a groove-shaped circulating communication channel through which the communication channel and the circulation flow channel communicate with each other. According to the configuration described above, it is possible to circulate a liquid inside the communication channel to the common liquid chamber via the circulating communication channel and the circulation flow channel.

CITATION LIST

Patent Literature

PTL 1: Japanese Unexamined Patent Application Publication No. 2012-143948

SUMMARY OF INVENTION

Technical Problem

In the technology in PTL 1, the front surface of the communication plate on which the nozzle plate is joined, is provided with the circulating communication channel. In such a configuration described above, it is actually difficult to efficiently circulate a liquid positioned in the vicinity of a nozzle to the circulation flow channel. With consideration for such circumstances described above, one of objects of a preferred aspect of the present invention is to efficiently circulate a liquid in the vicinity of a nozzle.

Solution to Problem

<Aspect 1>

In order to solve such a problem described above, according to a preferred aspect (aspect 1) of the present invention, there is provided a liquid ejecting head including: a nozzle plate provided with a first nozzle and a second nozzle; a flow channel forming unit provided with a first pressure chamber and a second pressure chamber to which a liquid is supplied, a first communication channel through which the first nozzle and the first pressure chamber communicate with each other, a second communication channel through which the second nozzle and the second pressure chamber communicate with each other, and a circulating liquid chamber that is positioned between the first communication channel and the second communication channel; and a pressure generating unit that generates a pressure change in each of the first pressure chamber and the second pressure chamber. The nozzle plate is provided with a first circulation channel through which the first communication channel and the circulating liquid chamber communicate with each other and a second circulation channel through which the second communication channel and the circulating liquid chamber communicate with each other. According to the aspect described above, since the first circulation channel, through which the first communication channel and the circulating liquid chamber communicate with each other, is formed in the nozzle plate, it is possible to more efficiently supply a liquid in the vicinity of a nozzle to the circulating liquid chamber than in a configuration of PTL 1 in which the circulating communication channel is formed in the communication plate. In addition, since the first circulation channel and the second circulation channel commonly communicate with the circulating liquid chamber positioned between the first communication channel and the second communication channel, an advantage is achieved in that a configuration of the liquid ejecting head is more simplified than in a configuration in which a circulating liquid chamber communicating with the first circulation channel is separately provided from a circulating liquid chamber communicating with the second circulation channel. In the following description, an amount of a liquid flowing into the circulating liquid chamber via the first circulation channel of the liquid circulating in the first communication channel is referred to as a "circulation amount", and an amount of a liquid that is ejected via the first nozzle of the liquid circulating in the first communication channel is referred to an "ejection amount".

<Aspect 2>

In a preferred example (aspect 2) according to the aspect 1, the first nozzle may be provided with a first zone and a second zone that has a diameter larger than that of the first zone and that is positioned on a side of the flow channel forming unit when viewed from the first zone. In the aspect described above, since the first nozzle is provided with the first zone and the second zone which have different inner diameters from each other, an advantage is achieved in that it is easy to set flow channel resistance of the first nozzle to a desired characteristic.

<Aspect 3>

In a preferred example (aspect 3) according to the aspect 2, the first circulation channel may have the same depth as a depth of the second zone. In the aspect described above, since the first circulation channel has the same depth as the depth of the second zone of the first nozzle, an advantage is achieved in that it is easier to form the first circulation channel and the second zone than in a configuration in which the first circulation channel and the second zone have different depths from each other.

<Aspect 4>

In a preferred example (aspect 4) according to the aspect 2, the first circulation channel may be deeper than the second zone. In the aspect described above, since the first circulation channel is deeper than the second zone of the first nozzle, the flow channel resistance of the first circulation channel is lower than that in a configuration in which the first circulation channel is shallower than the second zone. Hence, it is possible to more increase the circulation amount than in the configuration in which the first circulation channel is shallower than the second zone.

<Aspect 5>

In a preferred example (aspect 5) according to the aspect 2, the first circulation channel may be shallower than the second zone. In the aspect described above, since the first circulation channel is shallower than the second zone of the first nozzle, the flow channel resistance of the first circulation channel is higher than that in a configuration in which the first circulation channel is deeper than the second zone. Hence, it is possible to more increase the ejection amount than in the configuration in which the first circulation channel is deeper than the second zone.

<Aspect 6>

In a preferred example (aspect 6) according to any one of the aspects 2 to 5, the second zone may be continuous to the first circulation channel. In the aspect described above, the second zone of the first nozzle is continuous to the first circulation channel. Hence, the effect described above as remarkably achieved in that it as possible to efficiently circulate the liquid in the vicinity of the nozzle to the circulating liquid chamber.

<Aspect 7>

In a preferred example (aspect 7) according to any one of the aspects 1 to 5, the first nozzle and the first circulation channel may be separated from each other in a plane of the nozzle plate. In the aspect described above, the first nozzle and the first circulation channel are separated from each other. Hence, an advantage is achieved in that ensuring of the circulation amount is easily compatible with ensuring of the ejection amount.

<Aspect 8>

In a preferred example (aspect 8) according to the aspect 7, a flow channel length La of a portion of the first circulation channel, which overlaps the circulating liquid chamber, and a flow channel length Lb of a portion of the first circulation channel, which overlaps the first communication channel, may satisfy La>Lb. According to the aspect described above, an advantage is achieved in that it is easy to supply the liquid in the first communication channel to the circulating liquid chamber via the first circulation channel.

<Aspect 9>

In a preferred example (aspect 9) according to the aspect 8, a flow channel length Lc of a portion of the first circulation channel, which overlaps a partition wall between the first communication channel and the circulating liquid chamber in the flow channel forming unit may satisfy La>Lb>Lc. According to the aspect described above, an advantage is achieved in that it is easy to supply the liquid in the first communication channel to the circulating liquid chamber via the first circulation channel.

<Aspect 10>

In a preferred example (aspect 10) according to the aspect 6 or 7, a flow channel length La of a portion of the first circulation channel, which overlaps the circulating liquid chamber, and a flow channel length Lc of a portion of the first circulation channel, which overlaps a partition wall between the first communication channel and the circulating liquid chamber in the flow channel forming unit may satisfy La>Lc. According to the aspect described above, an advantage is achieved in that it is easy to supply the liquid in the first communication channel to the circulating liquid chamber via the first circulation channel.

<Aspect 11>

In a preferred example (aspect 11) according to any one of the aspects 1 to 10, a flow channel width of the first circulation channel may be smaller than a maximum diameter of the first nozzle. In the aspect described above, since the flow channel width of the first circulation channel is smaller than the maximum diameter of the first nozzle, the flow channel resistance of the first circulation channel is higher than that in a configuration in which the flow channel width of the first circulation channel is larger than the maximum diameter of the first nozzle. Hence, it is possible to increase the ejection amount.

<Aspect 12>

In a preferred example (aspect 12) according to any one of the aspects 1 to 11, the flow channel width of the first circulation channel may be smaller than a flow channel width of the first pressure chamber. In the aspect described above, since the flow channel width of the first circulation channel is smaller than the flow channel width of the first pressure chamber, the flow channel resistance of the first circulation channel is higher than that in a configuration in which the flow channel width of the first circulation channel is larger than the flow channel width of the first pressure chamber. Hence, it is possible to increase the ejection amount.

<Aspect 13>

In a preferred example (aspect 13) according to any one of the aspects 1 to 12, a flow channel width of a portion of the first circulation channel on a side of the circulating liquid chamber may be wider than a flow channel width of a portion thereof on a side of the first nozzle. In the aspect described above, since the flow channel width of the portion of the first circulation channel on the side of the circulating liquid chamber is wider than the flow channel width of the portion thereof on the side of the first nozzle, it is easy to supply the liquid in the first communication channel to the circulating liquid chamber via the first circulation channel. Hence, an advantage is achieved in that it is easy to ensure the circulation amount.

<Aspect 14>

In a preferred example (aspect 14) according to any one of the aspects 1 to 12, a flow channel width of an intermediate portion of the first circulation channel may be narrower than the flow channel width of the portion thereof on the side of the circulating liquid chamber and the flow channel width of the portion thereof on the side of the first nozzle when viewed from the intermediate portion. In the aspect described above, since the flow channel width of the intermediate portion of the first circulation channel is narrower than that of the portion thereof on the side of the circulating liquid chamber and that of the portion thereof on the side of the first nozzle, the flow channel resistance of the first circulation channel is higher than that in a configuration in which the flow channel width of the first circulation channel is constant. Hence, it is possible to increase the ejection amount.

<Aspect 15>

In a preferred example (aspect 15) according any one of the aspects 1 to 12, a flow channel width of an intermediate portion of the first circulation channel may be wider than the flow channel width of the portion thereof on the side of the circulating liquid chamber and the flow channel width of the portion thereof on the side of the first nozzle when viewed from the intermediate portion. In the aspect described above, since the flow channel width of the intermediate portion of the first circulation channel is wider than that of the portion thereof on the side of the circulating liquid chamber and that of the portion thereof on the side of the first nozzle, the flow channel resistance of the first circulation channel is lower than that in a configuration in which the flow channel width of the first circulation channel is constant. Hence, it is possible to increase the circulation amount.

<Aspect 16>

In a preferred example (aspect 16) according to any one of the aspects 1 to 15, a center axis of the first nozzle may be positioned on an opposite side of the circulating liquid chamber when viewed from a center axis of the first communication channel. In the aspect described above, since the center axis of the first nozzle is positioned on the opposite side of the circulating liquid chamber when viewed from the center axis of the first communication channel, it is possible to more decrease the circulation amount, and more increase the ejection amount than in a configuration in which the center axis of the first nozzle is positioned on the side of the circulating liquid chamber when viewed from the center axis of the first communication channel.

<Aspect 17>

In a preferred example (aspect 17) according to any one of the aspects 1 to 15, the center axis of the first nozzle may be positioned at the same location as the center axis of the first communication channel. In the aspect described above, as the center axis of the first nozzle and the center axis of the first communication channel are positioned at the same location, an advantage is achieved in that ensuring of the ejection amount is more easily compatible with ensuring of the circulation amount than in a configuration in which the center axis of the first nozzle and the center axis of the first communication channel are positioned at different locations from each other.

<Aspect 18>

In a preferred example (aspect 18) according to any one of the aspects 1 to 15, the center axis of the first nozzle may be positioned on the side of the circulating liquid chamber when viewed from the center axis of the first communication channel. In the aspect described above, since the center axis of the first nozzle is positioned on the side of the circulating liquid chamber when viewed from the center axis of the first communication channel, it is possible to more increase the circulation amount and more decrease the ejection amount than in a configuration in which the center axis of the first nozzle is positioned on the opposite side of the circulating liquid chamber when viewed from the center axis of the first communication channel.

<Aspect 19>

In a preferred example (aspect 19) according to any one of the aspects 1 to 18, the intermediate portion of the first circulation channel may be deeper than the portion thereof on the side of the circulating liquid chamber and the portion thereof on the side of the first nozzle when viewed from the intermediate portion. In the aspect described above, since the intermediate portion of the first circulation channel is deeper than the portion thereof on the side of the circulating liquid chamber and the portion thereof on the side of the first nozzle, the flow channel resistance of the first circulation channel is lower than that in a configuration in which the entire first circulation channel has a constant depth. Hence, it is possible to increase the circulation amount.

<Aspect 20>

In a preferred example (aspect 20) according to any one of the aspects 1 to 19, when a pressure change is generated in the first pressure chamber, an amount of the liquid that is supplied to the circulating liquid chamber via the first circulation channel may be larger than an amount of the liquid that is ejected from the first nozzle. In the aspect described above, the circulation amount is larger than the ejection amount. In other words, it is possible to effectively circulate the liquid in the vicinity of the nozzle to the circulating liquid chamber while the ejection amount is ensured.

<Aspect 21>

In a preferred example (aspect 21) according to any one of the aspects 1 to 20, the first circulation channel and the circulating liquid chamber may overlap each other, the first circulation channel and the first pressure chamber may overlap each other, and the circulating liquid chamber and the first pressure chamber may not overlap each other. In the aspect described above, the first circulation channel overlaps the circulating liquid chamber and the first pressure chamber, but the circulating liquid chamber and the first pressure chamber do not overlap each other. Hence, an advantage is achieved in that it is easier to decrease the liquid ejecting head in size than in a configuration in which the first circulation channel and the first pressure chamber do not overlap each other, for example.

<Aspect 22>

In a preferred example (aspect 22) according to any one of the aspects 1 to 20, the first circulation channel and the circulating liquid chamber may overlap each other, the first circulation channel and the pressure generating unit may overlap each other, and the circulating liquid chamber and the pressure generating unit may not overlap each other. In the aspect described above, the first circulation channel overlaps the circulating liquid chamber and the pressure generating unit, but the circulating liquid chamber and the pressure generating unit do not overlap each other. Hence, as advantage is achieved in that it is easier to decrease the liquid ejecting head in size than in a configuration in which the first circulation channel and the pressure generating unit do not overlap each other, for example.

<Aspect 23>

In a preferred example (aspect 23) according to any one of the aspects 1 to 20, an end surface of the first pressure chamber on a side of the first communication channel may be an inclined surface inclined with respect to an upper surface of the first pressure chamber, and the first circulation channel and the upper surface of the first pressure chamber may not overlap each other.

<Aspect 24>

In a preferred example (aspect 24) according to any one of the aspects 1 to 23, the first pressure chamber and the circulating liquid chamber may communicate with each other via the first communication channel and the first circulation channel. In the aspect described above, the first pressure chamber and the circulating liquid chamber communicate with each other in a joint manner via the first communication channel and the first circulation channel. Hence, it is possible to supply the liquid to the circulating liquid chamber while the ejection amount is more appropriately ensured than in a configuration in which the first pressure chamber and the circulating liquid chamber directly communicate with each other.

<Aspect 25>

In a preferred example (aspect 25) according to any one of the aspects 1 to 24, each of the nozzle plate and the flow channel forming unit may include a substrate formed by silicon. In the aspect described above, since each of the nozzle plate and the flow channel forming unit includes the silicon substrate, an advantage is achieved in that it is possible to form a flow channel in the nozzle plate and the flow channel forming unit with high accuracy by using a semiconductor manufacturing technology, for example.

<Aspect 26>

In a preferred example (aspect 26) according to any one of the aspects 1 to 25, the nozzle plate may be provided with a common circulation channel that is continuous to the first circulation channel and the second circulation channel. In the aspect described above, since the common circulation channel that is continuous to the first circulation channel and the second circulation channel is formed in the nozzle plate, it is possible to more increase a flow channel area of the liquid than in a configuration in which the common circulation channel is not formed.

<Aspect 27>

According to another preferred aspect of the present invention, there is provided a liquid ejecting apparatus including the liquid ejecting head according to any one of the aspects exemplified above. A preferable example of the liquid ejecting apparatus is a printing apparatus that ejects ink; however, a use of the liquid ejecting apparatus according to the present invention is not limited to printing.

DESCRIPTION OF EMBODIMENTS

First Embodiment

Figure 1:
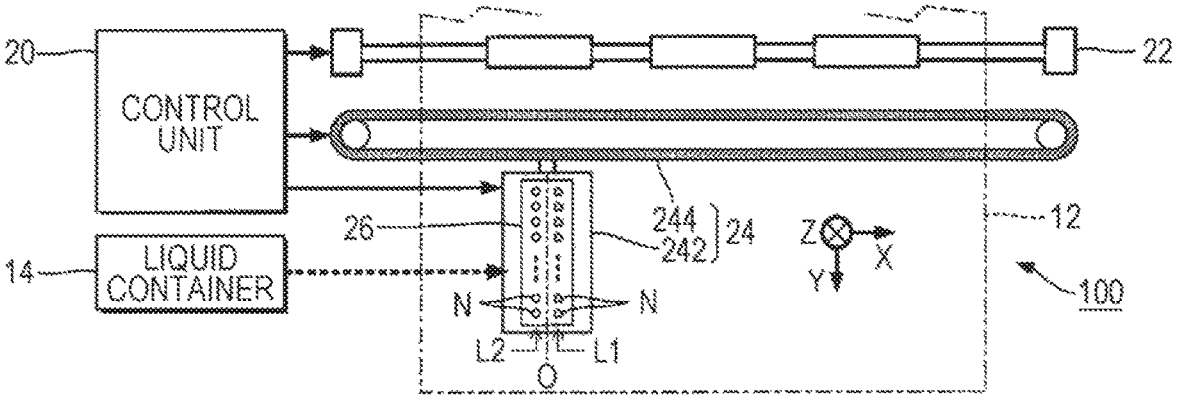
FIG. 1 is a diagram of a configuration of a liquid ejecting apparatus according to a first embodiment of the present invention.

FIG. 1 is a diagram of a configuration exemplifying a liquid ejecting apparatus 100 according to a first embodiment of the present invention. The liquid ejecting apparatus 100 of the first embodiment is an ink jet type printing apparatus that ejects ink as an example of a liquid to a medium 12. The medium 12 is a common printing sheet, and any printing target made of any material such as a resin film or cloth can be used as the medium 12. As illustrated in FIG. 1, a liquid container 14 that stores inks is disposed in the liquid ejecting apparatus 100. For example, a cartridge, a pouch-shaped ink bag formed by a flexible film, or a refillable ink tank, which is attachable to and detachable from the liquid ejecting apparatus 100, is used as the liquid container 14. A plurality of types of different color inks are stored in the liquid container 14.

As illustrated in FIG. 1, the liquid ejecting apparatus 100 includes a control unit 20, a transport mechanism 22, a moving mechanism 24, and a liquid ejecting head 26. For example, the control unit 20 includes a processing circuit such as a central processing unit (CPU) or a field programmable gate array (FPGA) and a memory circuit such as a semiconductor memory and collectively controls elements of the liquid ejecting apparatus 100. The transport mechanism 22 transports the medium 12 in a Y direction under control by the control unit 20.

The moving mechanism 24 causes the liquid electing head 26 to reciprocate in an X direction under the control by the control unit 20. The X direction is a direction intersecting with (typically, orthogonal to) the Y direction in which the medium 12 is transported. The moving mechanism 24 of the first embodiment has a substantially box-shaped transport member 242 (carriage), which accommodates the liquid ejecting head 26, and a transport belt 244 to which the transport member 242 is fixed. It is possible to employ a configuration in which a plurality of liquid ejecting heads 26 are mounted on the transport member 242 or a configuration in which the liquid container 14 and the liquid ejecting head 26 are both mounted on the transport member 242.

The liquid ejecting head 26 eject ink, which is supplied from the liquid container 14, to the medium 12 from a plurality of nozzles N (ejecting holes) under the control by the control unit 20. The liquid ejecting head 26 ejects the inks to the medium 12 in parallel with transport of the medium 12 by the transport mechanism 22 and repeated reciprocating of the transport member 242, and thereby a desired image is formed on a front surface of the medium 12. Hereinafter, a direction perpendicular to an X-Y plane (for example, a plane parallel to the front surface of the medium 12) is referred to as a Z direction, A direction (typically, vertical direction) of ejecting ink by the liquid ejecting head 26 corresponds to the Z direction.

As illustrated in FIG. 1, the plurality of nozzles N of the liquid ejecting head 26 are arranged in the Y direction. The plurality of nozzles N of the first embodiment is divided into a first array L1 and a second array L2 which are provided side by side with a gap between the rows in the X direction. The first array L1 and the second array 12 are each a set of the plurality of nozzles N arranged linearly in the Y direction. Positions of the nozzles N in the Y direction can be different between the first array L1 and the second array L2 (that is, a zigzag arrangement or a staggered arrangement). However, a configuration in which the positions of the nozzles N in the Y direction are coincident with each other in the first array L1 and the second array L2 will be described for descriptive purposes, hereinafter. A plane (Y-Z plane) O that passes through a center axis parallel to the Y direction and that is parallel to the Z direction in the liquid ejecting head 26 is referred to as a "center plane" in the following description.

Figure 2:
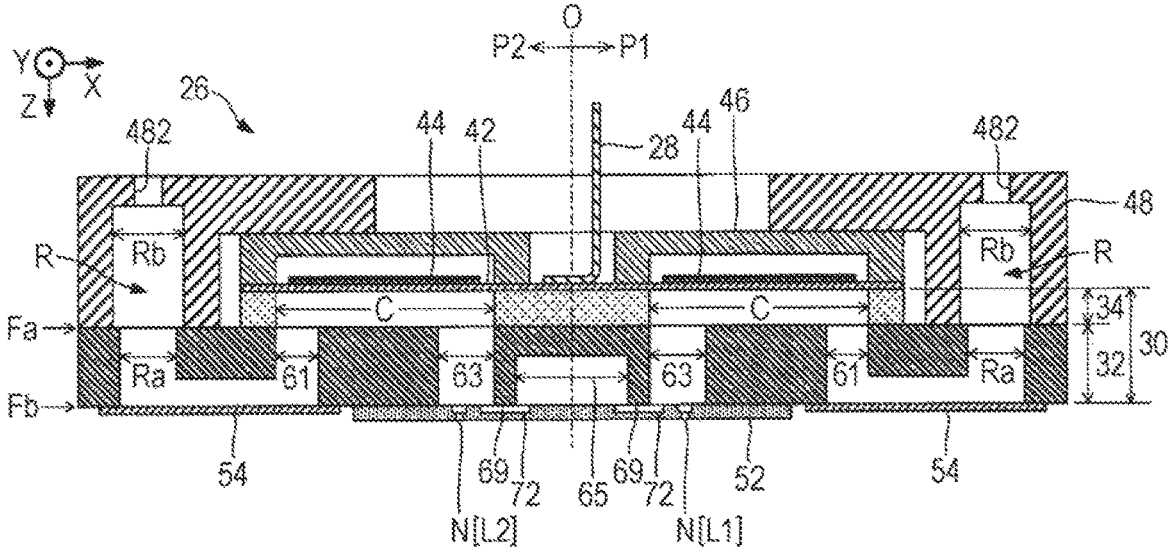
FIG. 2 is a sectional view of a liquid ejecting head.
Figure 3:
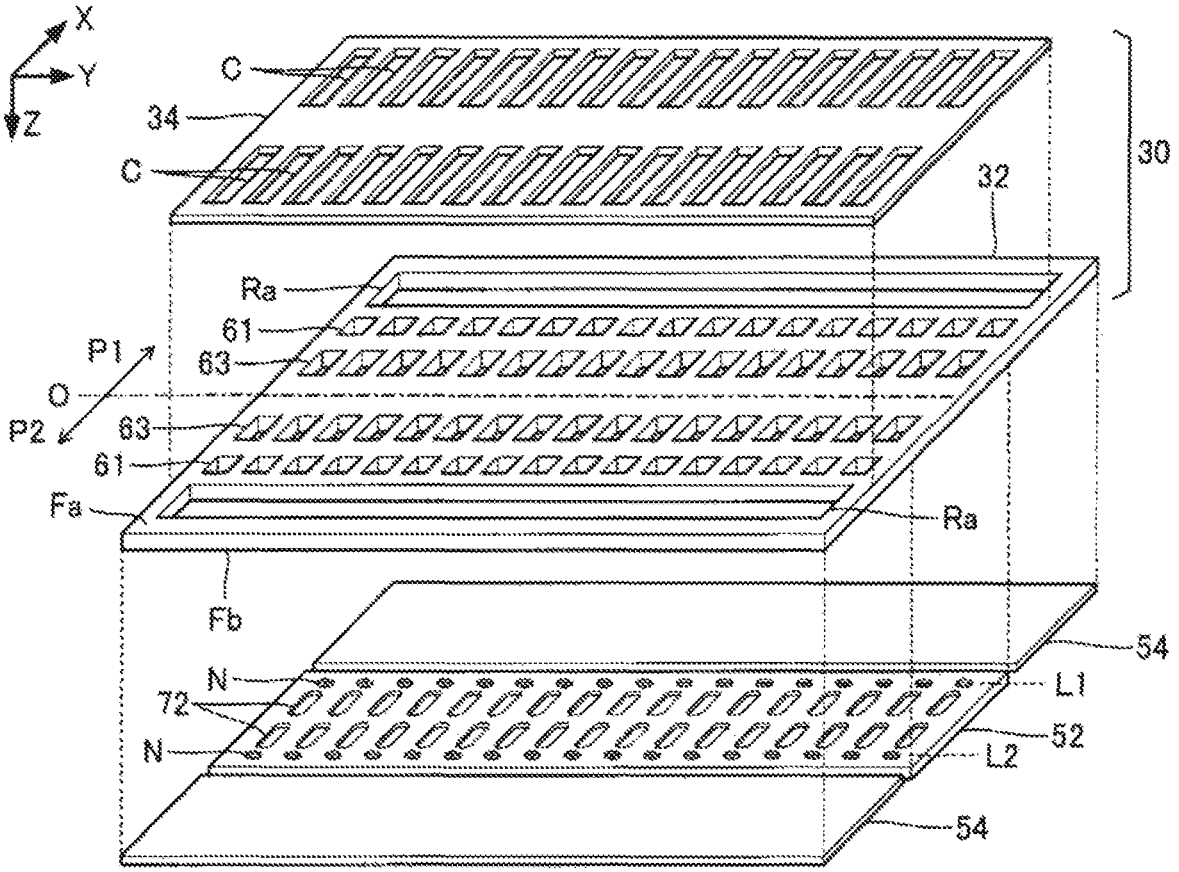
FIG. 3 is a partially exploded perspective view of the liquid ejecting head.

FIG. 2 is a sectional view of the liquid ejecting head 26 on a section perpendicular to the Y direction, and FIG. 3 is a partially exploded perspective view of the liquid ejecting head 26. As understood from FIGS. 2 and 3, the liquid ejecting head 26 of the first embodiment has a structure in which an element related to the nozzles N of the first array L1 (exemplifying a first nozzle) and an element related to the nozzles N of the second array L2 (exemplifying a second nozzle) are disposed in plane symmetry with the center plane O interposed therebetween. In other words, a structure of a portion (hereinafter, referred to as a "first portion") P1 on a positive side in the X direction and a portion (hereinafter, referred to as a "second portion") P2 on a negative side in the X direction with the center plane O interposed the portions of the liquid ejecting head 26 is practically common. The plurality of nozzles N in the first array L1 are formed in the first portion P1, and the plurality of nozzles N in the second array L2 are formed in the second portion P2. The center plane O corresponds to a boundary plane between the first portion P1 and the second portion P2.

As illustrated in FIGS. 2 and 3, the liquid ejecting head 26 includes a flow channel forming unit 30. The flow channel forming unit 30 is a structure provided with flow channels for supplying ink to the plurality of nozzles N. The flow channel forming unit 30 of the first embodiment has a configuration in which a first flow channel substrate 32 (communication plate) and a second flow channel substrate 34 (pressure chamber forming plate) are stacked. Each of the first flow channel substrate 32 and the second flow channel substrate 34 is a plate-like member elongated in the Y direction. The second flow channel substrate 34 is disposed on a front surface Fa of the first flow channel substrate 32 on a negative side in the Z direction, by using an adhesive, for example.

As illustrated in FIG. 2, on the front surface Fa of the first flow channel substrate 32, a vibrating unit 42, a plurality of piezoelectric elements 44, a protective member 46, and a housing 48 are disposed, in addition to the second flow channel substrate 34, (not illustrated in FIG. 3). On the other hand, a nozzle plate 52 and a vibration absorber 54 are disposed on a front surface Fb of the first flow channel substrate 32 on a positive side (that is, an opposite side of the front surface Fa) in the Z direction. Elements of the liquid ejecting head 26 are schematically plate-like members elongated in the Y direction similarly to the first flow channel substrate 32 and the second flow channel substrate 34 and are joined to each other by using an adhesive, for example. It is possible to determine, as the Z direction, a direction in which the first flow channel substrate 32 and the second flow channel substrate 34 are stacked and a direction (or a direction perpendicular to front surfaces of plate-like elements) in which the first flow channel substrate 32 and the nozzle plate 52 are stacked.

The nozzle plate 52 is a plate-like member provided with the plurality of nozzles N and is disposed on the front surface Fb of the first flow channel substrate 32 by using an adhesive, for example. Each of the plurality of nozzles N is a circular through-hole through which the ink passes. The nozzle plate 52 of the first embodiment is provided with the plurality of nozzles N that configure the first array L1 and the plurality of nozzles N that configure the second array L2. Specifically, when viewed from the center plane O, the plurality of nozzles N of the first array L1 are formed along the Y direction in a region of the nozzle plate 52 on the positive side of the X direction, and the plurality of nozzles N of the second array L2 are formed along the Y direction in a region thereof on the negative side in the X direction. The nozzle plate 52 of the first embodiment is a single plate-like member in which a portion provided with the plurality of nozzles N of the first array L1 and a portion provided with the plurality of nozzles N of the second array L2 are continuous to each other. The nozzle plate 52 of the first embodiment is manufactured by processing a silicon (Si) monocrystalline substrate by using a semiconductor manufacturing technology (for example, a processing technology such as dry etching or wet etching). However, it is possible to optionally employ a known material or manufacturing method for manufacturing the nozzle plate 52.

As illustrated in FIGS. 2 and 3, the first flow channel substrate 32 is provided with a space Ra, a plurality of supply channels 61, and a plurality of communication channels 63 in each of the first portion P1 and the second portion P2. The space Ra is an opening formed into an elongated shape along the Y direction in a plan view (that is, viewed from the Z direction), and the supply channel 61 and the communication channel 63 are through-holes formed for each nozzle N. The plurality of communication channels 63 are arranged in the Y direction in a plan view, and the plurality of supply channels 61 are arranged in the Y direction between the arrangement of the plurality of communication channels 63 and the space Ra. The plurality of supply channels 61 commonly communicate with the space Ra. In addition, any one communication channel 63 overlaps a nozzle N corresponding to the communication channel 63 in a plan view. Specifically, any one communication channel 63 of the first portion P1 communicates with one nozzle N of the first array L1, the nozzle corresponding to the communication channel 63. Similarly, any one communication channel 63 of the second portion P2 communicates with one nozzle N of the second array L2, the nozzle corresponding to the communication channel 63.

As illustrated in FIGS. 2 and 3, the second flow channel substrate 34 is a plate-like member provided with a plurality of pressure chambers C in each of the first portion P1 and the second portion P2. The plurality of pressure chambers C are arranged in the Y direction. The pressure chamber C (cavity) is a space that is formed for each nozzle N and that has an elongated shape along the X direction in a plan view. Similarly to the nozzle plate 52 described above, the first flow channel substrate 32 and the second flow channel substrate 34 are manufactured by processing a silicon monocrystalline substrate using a semiconductor manufacturing technology, for example. However, it is possible to optionally employ a known material or manufacturing method for manufacturing the first flow channel substrate 32 and the second flow channel substrate 34. As described above, in the first embodiment, the flow channel forming unit 30 (the first flow channel substrate 32 and the second flow channel substrate 34) and the nozzle plate 52 contain a substrate formed by silicon. Hence, the semiconductor manufacturing technology is used as described above, and thereby an advantage is achieved in that it possible to form a fine flow channel in the flow channel forming unit 30 and the nozzle plate 52 with high accuracy.

As illustrated in FIG. 2, the vibrating unit 42 is disposed on a front surface of the second flow channel substrate 34 on an opposite side of the first flow channel substrate 32. The vibrating unit 42 of the first embodiment is a pate-like member (vibrating plate) that can elastically vibrate. A part of region of the plate-like member having a predetermined thickness in a plate thickness direction is selectively removed, the region corresponding to the pressure chamber C, and thereby it is possible to integrally form the second flow channel substrate 34 and the vibrating unit 42.

As understood from FIG. 2, the front surface Fa of the first flow channel substrate 32 and the vibrating unit 42 are opposite to each other with a gap therebetween on an inner side of each pressure chamber C. The pressure chamber C is a space positioned between the front surface Fa of the first flow channel substrate 32 and the vibrating unit 42 and generates a pressure change in ink with which the space is filled. Each of the pressure chambers C is a space having a longitudinal direction in the X direction and is individually formed for each nozzle N. A plurality of pressure chambers C are arranged in the Y direction for each of the first array L1 and the second array L2. As illustrated in FIGS. 2 and 3, an end portion of any one pressure chamber C on a side of the center plane O overlaps the communication channel 63 in a plan view, and an end portion thereof on the opposite side of the center plane O overlaps the supply channel 61 in a plan view. Hence, the pressure chambers C communicate with the nozzles N via the communication channels 63 in each of the first portion P1 and the second portion P2 and communicate with the space Ra via the supply channels 61. The pressure chamber C as provided with a narrowed flow channel having a constricted flow channel width, and thereby it is possible to apply predetermined flow channel resistance.

Figure 4:
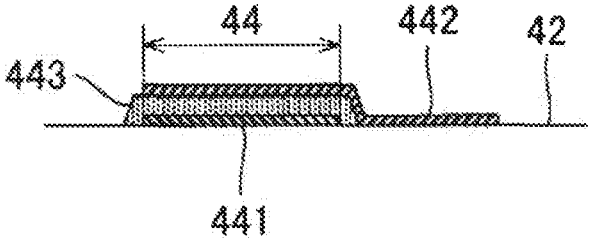
FIG. 4 is a sectional view of a piezoelectric element.

As illustrated in FIG. 2, the plurality of piezoelectric elements 44 corresponding to different nozzles N from each other are disposed on a surface of the vibrating unit 42 on an opposite side of the pressure chambers C, in each of the first portion P1 and the second portion P2. The piezoelectric element 44 is a passive element that changes due to a supply of a drive signal. The plurality of piezoelectric elements 44 are arranged in the Y direction so as to correspond to the pressure chambers C. As illustrated in FIG. 4, any one piezoelectric element 44 is a stacked body in which a piezoelectric layer 443 is sandwiched between a first electrode 441 and a second electrode 442 which are opposite to each other. One of the first electrode 441 and the second electrode 442 can be an electrode (that is, common electrode) that is continuous over the plurality of piezoelectric elements 44. A portion in which the first electrode 441, the second electrode 442, and the piezoelectric layer 443 overlap each other functions as the piezoelectric element 44. A portion (that is, an active portion that vibrates the vibrating unit 42) that changes due to the supply of the drive signal can be demarcated as the piezoelectric element 44. As understood from the description provided above, the liquid ejecting head 26 of the first embodiment includes a first piezoelectric element and a second piezoelectric element. For example, the first piezoelectric element is the piezoelectric element 44 on one side (for example, the right side in FIG. 2) in the X direction when viewed from the center plane O, and the second piezoelectric element is the piezoelectric element 44 on the other side (for example, the left side in FIG. 2) in the X direction when viewed from the center plane O. When the vibrating unit 42 vibrates along with deformation of the piezoelectric element 44, a pressure in the pressure chamber C changes, and thereby ink, with which the pressure chamber C is filled, passes through the communication channel 63 and the nozzle N and is ejected.

The protective member 46 of FIG. 2 is a plate-like member for protecting the plurality of piezoelectric elements 44 and is disposed on a front surface of the vibrating unit 42 (or a front surface of the second flow channel substrate 34). Any material or any manufacturing method of the protective member 46 can be employed; however, similarly to the first flow channel substrate 32 and the second flow channel substrate 34, the protective member 46 can be formed by processing a silicon (Si) monocrystalline substrate by using a semiconductor manufacturing technology, for example. The plurality of piezoelectric elements 44 are accommodated in a recessed portion formed on a front surface of the protective member 46 on a side of the vibrating unit 42.

An end portion of a wiring substrate 28 is joined to the front surface of the vibrating unit 42 (front surface of the flow channel forming unit 30) on the opposite side of the flow channel forming unit 30. The wiring substrate 28 is a flexible mounting component provided with a plurality of wires (not shown) that electrically couples the control unit 20 to the liquid ejecting head 26. An end portion of the wiring substrate 28, which passes through an opening portion formed in the protective member 46 and an opening portion formed in the housing 48 and extends outside, is coupled to the control unit 20. For example, the flexible wiring substrate 28 such as a flexible printed circuit (FPC) or a flexible flat cable (FFC) is preferably employed.

The housing 48 is a case for storing ink that is supplied to the plurality of pressure chambers C (further to the plurality of nozzle N). For example, a front surface of the housing 48 on the positive side in the Z direction is joined to the front surface Fa of the first flow channel substrate 32 with an adhesive. It is possible to optionally employ a known material or manufacturing method for manufacturing the housing 48. For example, it is possible to form the housing 48 by injection molding of a resin material.

As illustrated in FIG. 2, the housing 48 of the first embodiment is provided with a space Rb in each of the first portion P1 and the second portion P2. The zone Rb of the housing 48 and the space P3 of the first flow channel substrate 32 communicate with each other. A space configured of the space Ra and the space Rb functions as a liquid reservoir (reservoir) R that stores ink that is supplied to the plurality of pressure chambers C. The liquid reservoir R is a common liquid chamber that is common to the plurality of nozzles N. The liquid reservoir R is formed in each of the first portion P1 and the second portion P2. The liquid reservoir R of the first portion P1 is positioned on the positive side in the X direction when viewed from the center plane O, and the liquid reservoir R of the second portion P2 is positioned on the negative side in the X direction when viewed from the center plane O. A front surface of the housing 48 on the opposite side of the first flow channel substrate 32 is provided with an introduction port 482 for introducing ink, which is supplied from the liquid container 14, to the liquid reservoir R.

As illustrated in FIG. 2, the vibration absorber 54 is disposed on the front surface Fb of the first flow channel substrate 32 in each of the first portion P1 and the second portion P2. The vibration absorber 54 is a flexible film (compliance substrate) that absorbs a pressure change of ink in the liquid reservoir R. As illustrated in FIG. 3, the vibration absorber 54 disposed on the front surface Fb of the first flow channel substrate 32 so as to block the space Ra and the plurality of supply channels 61 of the first flow channel substrate 32 and configures a wall surface (specifically, a bottom surface) of the liquid reservoir R.

As illustrated in FIG. 2, a space (hereinafter, referred to as a "circulating liquid chamber") 65 is formed on the front surface Fb of the first flow channel substrate 32, which is opposite to the nozzle plate 52. The circulating liquid chamber 65 of the first liquid is a bottomed hole (groove) having an elongated shape extending in the Y direction in a plan view. The nozzle plate 52 joined to the front surface Fb of the first flow channel substrate 32 blocks an opening of the circulating liquid chamber 65.

Figure 5:
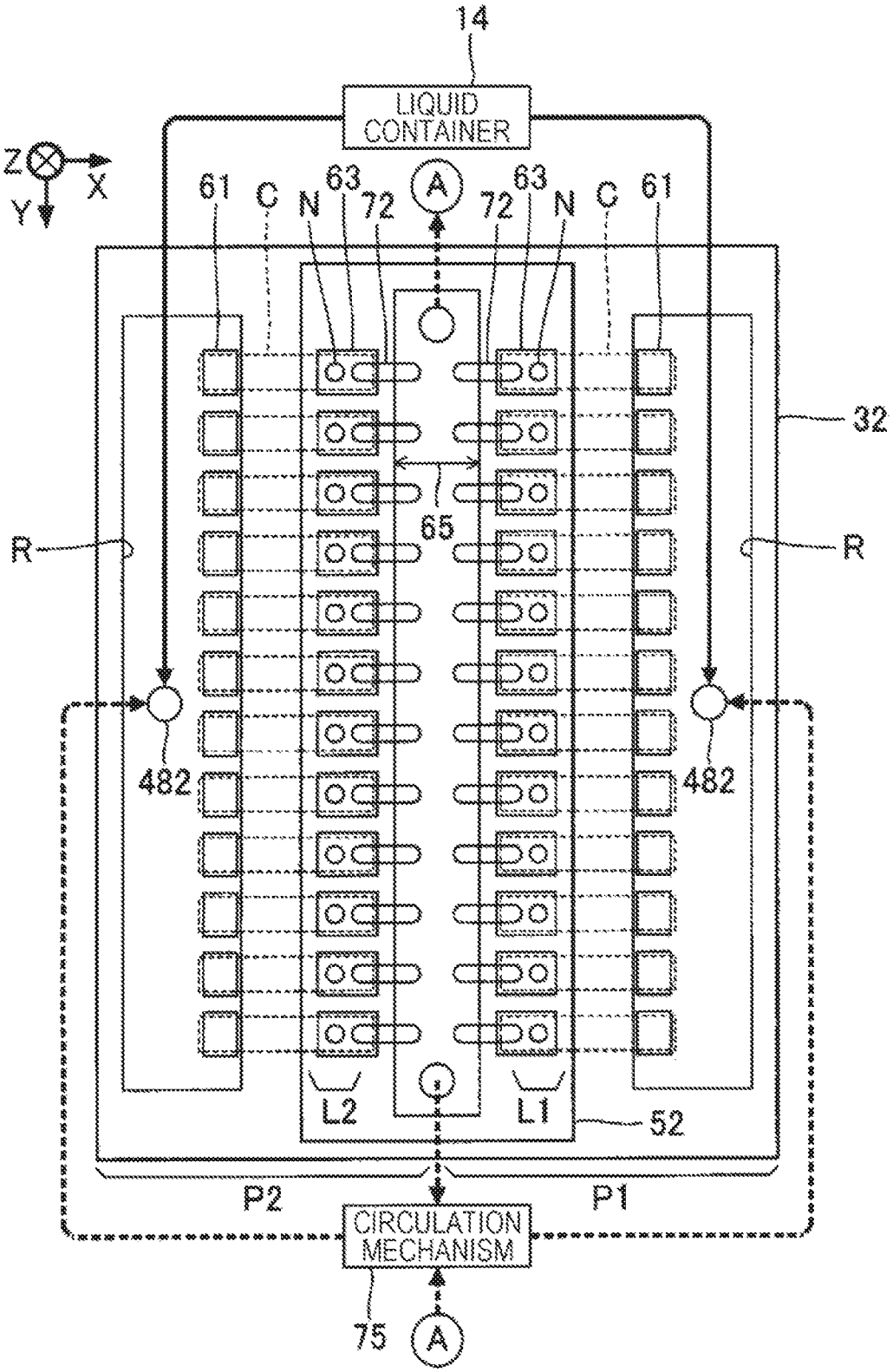
FIG. 5 is a diagram showing circulation of ink in the liquid ejecting head.

FIG. 5 is a diagram showing a configuration of the liquid ejecting head 26 by focusing on the circulating liquid chamber 65. As illustrated in FIG. 5, the circulating liquid chamber 65 is continuous over the plurality of nozzles N along the first array L1 and the second array L2. Specifically, the circulating liquid chamber 65 is positioned between the arrangement of the plurality of nozzles N of the first array L1 and the arrangement of the plurality of nozzles N of the second array L2. Hence, as illustrated in FIG. 2, the circulating liquid chamber 65 is positioned between the communication channels 63 in the first portion P1 and the communication channels 63 in the second portion P2. As understood from the description provided above, the flow channel forming unit 30 of the first embodiment is a structure provided with the pressure chambers C (first pressure chambers) and the communication channels 63 (first communication channels) in the first portion P1, the pressure chambers C (second pressure chambers) and the communication channels 63 (second communication channels) in the second portion P2, and the circulating liquid chamber 65 positioned between the communication channels 63 in the first portion P1 and the communication channels 63 in the second portion P2. As illustrated in FIG. 2, the flow channel forming unit 30 of the first embodiment includes a partition wall-shaped portion (hereinafter, referred to as a "partition wall") 69 between the circulating liquid chamber 65 and the communication channels 63.

As described above, the plurality of pressure chambers C and the plurality of piezoelectric elements 44 are arranged in the Y direction in each of the first portion P1 and the second portion P2. This can also be described as follows. The circulating liquid chamber 65 extends in the Y direction to be continuous over the plurality of pressure chambers C or the plurality of piezoelectric elements 44 in each of the first portion P1 and the second portion P2. In addition, as understood from FIGS. 2 and 3, the circulating liquid chamber 65 and the liquid reservoir R extend in the Y direction with a gap therebetween, and the pressure chambers C, the communication channels 63, and the nozzles N can be positioned in the gap.

Figure 6:
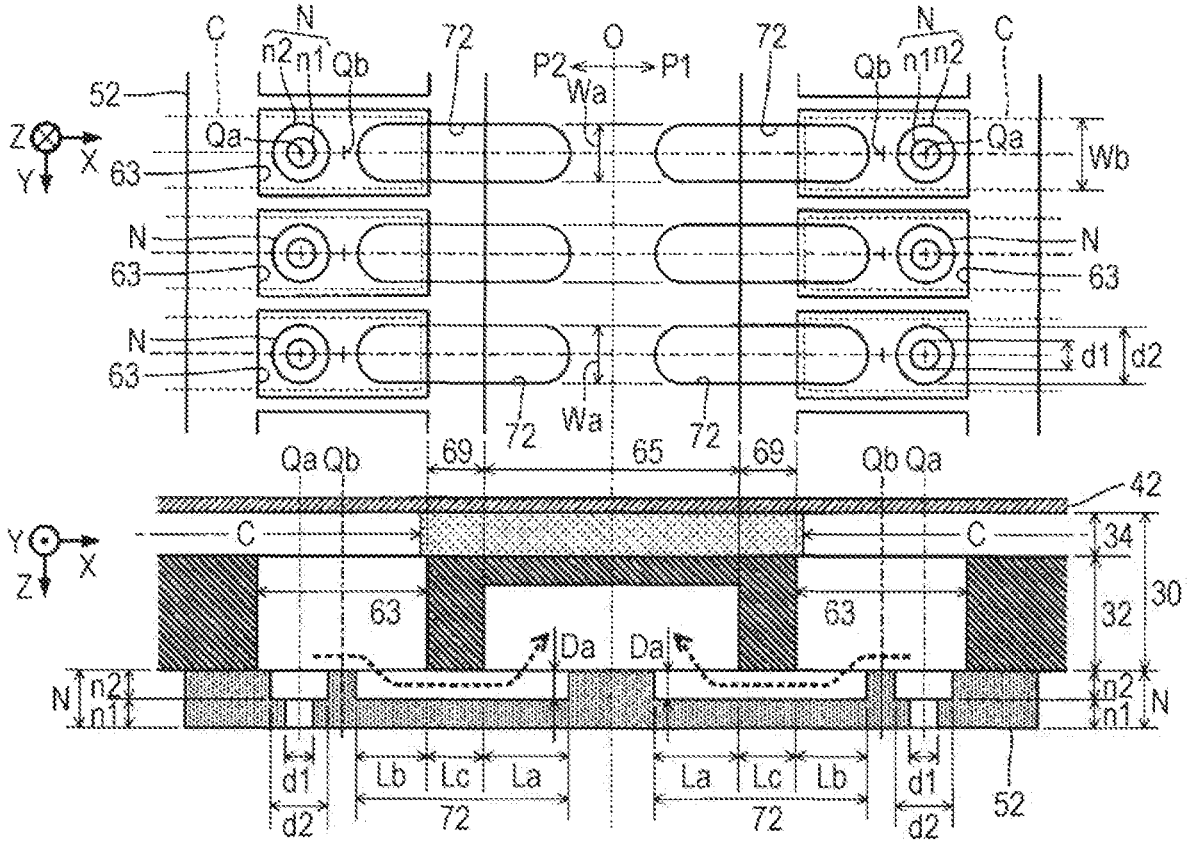
FIG. 6 shows a plan view and a sectional view in the vicinity of a circulating liquid chamber of the liquid ejecting head.

FIG. 6 shows as enlarged plan view and an enlarged sectional view of a portion in the vicinity of the circulating liquid chamber 65 of the liquid ejecting head 26. As illustrated in FIG. 6, one nozzle N according to the first embodiment contains a first zone n1 and a second zone n2. The first zone n1 and the second zone n2 are coaxially formed to be circular spaces that communicate with each other. The second zone n2 is positioned on a side of the flow channel forming unit 30 viewed from the first zone n1. An inner diameter d2 of the second zone n2 is larger than an inner diameter d1 of the first zone n1 (d2>d1). As described above, according to a configuration in which the nozzles N are formed in a step shape, an advantage is achieved in that it is easy to set flow channel resistance of the nozzles N to a desired characteristic. In addition, as illustrated in FIG. 6, a center axis Qa of the nozzles N according to the first embodiment is positioned on an opposite side of the circulating liquid chamber 65 when viewed from a center axis Qb of the communication channels 63.

As illustrated in FIG. 6, a plurality of circulation channels 72 in each of the first portion P1 and the second portion P2 are formed on a front surface of the nozzle plate 52, which is opposite to the flow channel forming unit 30. A plurality of circulation channels 72 (exemplifying first circulation channels) of the first portion P1 correspond to the plurality of nozzles N of the first array L1 (or the plurality of communication channels 63 corresponding to the first array L1), respectively. In addition, a plurality of circulation channels 72 (exemplifying second circulation channels) of the second portion P2 correspond to the plurality of nozzles N of the second array L2 (or the plurality of communication channels 63 corresponding to the second array L2), respectively.

Each of the circulation channels 72 is a groove (that is, a bottomed hole having an elongated shape) extending in the X direction and functions as a flow channel through which the ink is circulated. The circulation channel 72 of the first embodiment is formed at a position separated from the nozzle N (specifically, on a side of the circulating liquid chamber 65 when viewed from the nozzle N corresponding to the circulation channel 72). For example, the plurality of nozzles N (particularly, the second zone n2) and the plurality of circulation channels 72 are collectively formed in a common process by the semiconductor manufacturing technology (for example, a processing technology such as dry etching or wet etching).

As illustrated in FIG. 6, each of the circulation channels 72 is formed into a linear shape having a flow channel width Wa that is equal to the inner diameter d1 of the second zone n2 of the nozzle N. In addition, the flow channel width (dimension in the Y direction) Wa of the circulation channel 72 according to the first embodiment is narrower than a flow channel width (dimension in the Y direction) Wb of the pressure chamber C. Hence, it is possible to more increase the flow channel resistance of the circulation channel 72 than in a configuration in which the flow channel width Wa of the circulation channel 72 is wider than the flow channel width Wb of the pressure chamber C. On the other hand, a depth Da of the circulation channel 72 with respect to the surface of the nozzle plate 52 is constant over the entire length thereof. Specifically, the circulation channels 72 are formed at the same depth as that of the second zones n2 of the nozzles N. According to the configuration described above, an advantage is achieved in that it is easier to form the circulation channel 72 and the second zone n2 than in a configuration in which the circulation channel 72 and the second zone n2 are formed to have different depths from each other. The "depth" of the flow channel means a depth of the flow channel in the Z direction (for example, a difference in height between a flow channel formed surface and a bottom surface of the flow channel).

Any one circulation channel 72 in the first portion P1 is positioned on the side of the circulating liquid chamber 65 when viewed from the nozzle N of the first array L1, the nozzle corresponding to the circulation channel 72. In addition, any one circulation channel 72 in the second portion P2 is positioned on the side of the circulating chamber 65 when viewed from the nozzle N of the second array L2, the nozzle corresponding to the circulation channel 72. An end portion of the circulation channel 72 on the opposite side (side of the communication channel 63) of the center plane O overlaps one communication channel 63 corresponding to the circulation channel 72 in a plan view. In other words, the circulation channel 72 communicates with the communication channel 63. On the other hand, an end portion of the circulation channel 72 on the side (side of the circulating liquid chamber 65) of the center plane C) overlaps the circulating liquid chamber 65 in a plan view. In other words, the circulation channel 72 communicates with the circulating liquid chamber 65. As understood from the description provided above, each of the plurality of communication channels 63 communicates with the circulating liquid chamber 65 via the circulation channel 72. Hence, as illustrated by a dashed-line arrow in FIG. 6, the ink in the communication channels 63 is supplied to the circulating liquid chamber 65 via the circulation channels 72. In other words, in the first embodiment, the plurality of communication channels 63 corresponding to the first array L1 and the plurality of communication channels 63 corresponding to the second array L2 commonly communicate with the one circulating liquid chamber 65.

FIG. 6 illustrates a flow channel length La of a portion of any one circulation channel 72 that overlaps the circulating liquid chamber 65, a flow channel length (dimension in the X direction) Lb of a portion of the circulation channel 72 that overlaps the communication channel 63, and a flow channel length (dimension in the X direction) Lc of a portion of the circulation channel 72 that overlaps the partition wall 69 of the flow channel forming unit 30. The flow channel length to corresponds to a thickness of the partition wall 69. The partition wall 69 functions as a narrowed portion of the circulation channel 72. Hence, the longer the flow channel length Lc corresponding to the thickness of the partition wall 69 is, the more the flow channel resistance of the circulation channel 72 increases. In the first embodiment, a relationship that the flow channel length La is longer than the flow channel length Lb (La>Lb), and the flow channel length La is longer than the flow channel length Lc (La>Lc) is established. Further, in the first embodiment, a relationship that the flow channel length Lb is longer the flow channel length Lc (Lb>Lc) is established (La>Lb>Lc). According to the configuration described above, an advantage is achieved in that it is easier for ink to flow into the circulating liquid chamber 65 from the communication channel 63 via the circulation channel 72 than in a configuration in which the flow channel length La or the flow channel length Lb is shorter than the flow channel length Lc.

As described above, in the first embodiment, the pressure chamber C indirectly communicates with the circulating liquid chamber 65 via the communication channel 63 and the circulation channel 72. In other words, the pressure chamber C and the circulating liquid chamber 65 do not directly communicate with each other. In the configuration described above, when the pressure in the pressure chamber C changes due to an operation of the piezoelectric element 44, a part of ink flowing in the communication channel 63 is ejected outside from the nozzle N, and a part of the rest ink flows into the circulating liquid chamber 65 from the communication channel 63 through the circulation channel 72. In the first embodiment, inertance of the communication channel 63, the nozzle, and the circulation channel 72 is selected such that an amount of ink that is ejected via the nozzle N (hereinafter, referred to as an "ejection amount") of the ink circulating in the communication channel 63 by driving the piezoelectric element 44 once is larger than an amount of ink that flows into the circulating liquid chamber 65 via the circulation channel 72 (hereinafter, referred to as a "circulation amount") of the ink circulating in the communication channel 63. This can also be described as follows. When a case of driving all of the piezoelectric elements 44 at once is assumed, a total of circulation amounts of flowing into the circulating liquid chamber 65 from the plurality of communication channels 63 (for example, a flow amount in the circulating liquid chamber 65 within a unit time) is larger than a total of ejection amounts by the plurality of nozzles N.

Specifically, the flow channel resistance of each of the communication channel 63, the nozzle, and the circulation channel 72 is determined such that a ratio of the circulation amount to the ink circulating in the communication channel 63 is equal to or higher than 70% (a ratio of the ejection amount is equal to or lower than 30%). According to the configuration described above, it is possible to effectively circulate ink in the vicinity the nozzle to the circulating liquid chamber 65 while the ejection amount of the ink is ensured. Schematically, the higher the flow channel resistance of the circulation channel 72 is, the more the circulation amount decreases, whereas the more the ejection amount increases. The lower the flow channel resistance of the circulation channel 72 is, the more the circulation amount tends to increase, whereas the more the ejection amount decreases.

As illustrated in FIG. 5, the liquid ejecting apparatus 100 of the first embodiment includes a circulation mechanism 75. The circulation mechanism 75 is a mechanism that supplies (that is, circulates) the ink in the circulating liquid chamber 65 to the liquid reservoir R. For example, the circulation mechanism 75 of the first embodiment has a suction mechanism (for example, a pump) that suctions ink from the circulating liquid chamber 65, a filter mechanism that captures bubbles or foreign matter which is mixed with the ink, and a heating mechanism that lowers thickening by heating the ink (not shown). The circulation mechanism 75 removes the bubbles or foreign matter, and ink, of which the thickening is lowered, is supplied to the liquid reservoir R from the circulation mechanism 75 via the introduction port 482. As understood from the description provided above, in the first embodiment, the ink circulates through the liquid reservoir R, the supply channel 61, the pressure chamber C, the communication channel 63, the circulation channel 72, the circulating liquid chamber 65, the circulation mechanism 75, and the liquid reservoir R in this order.

As understood from FIG. 5, the circulation mechanism 75 of the first embodiment suctions the ink from both sides of the circulating liquid chamber 65 in the Y direction. In other words, the circulation mechanism 75 suctions ink from the vicinity of an end portion of the circulating liquid chamber 65 on a negative side in the Y direction and the vicinity of an end portion of the circulating liquid chamber 65 on a positive side in the Y direction. In a configuration in which ink is suctioned only one end portion of the circulating liquid chamber 65 in the Y direction, a difference in pressure of the ink can occur between both end portions of the circulating liquid chamber 65, and the pressure of the ink in the communication channel 63 can be different depending on a position in the Y direction due to a pressure difference in the circulating liquid chamber 65. Hence, there is a possibility that an ejection characteristic (for example, the ejection amount or an ejection speed) of ink from the nozzles is different depending on a position in the Y direction. In contrast to the configuration described above, in the first embodiment, since the ink is suctioned from both sides of the circulating liquid chamber 65, the pressure difference inside the circulating liquid chamber 65 decreases. Hence, it is possible to obtain approximate ejection characteristics of ink over the plurality of nozzles N arranged in the Y direction with high accuracy. However, in a case where the pressure difference in the circulating chamber 65 in the Y direction is not particularly high, it is also possible to employ a configuration in which the ink is suctioned from one end portion of the circulating liquid chamber 65.

As described above, the circulation channel 72 and the communication channel 63 overlap each other in a plan view, and the communication channel 63 and the pressure chamber C overlap each other in a plan view. Hence, the circulation channel 72 and the pressure chamber C overlap each other in a plan view. On the other hand, as understood from FIGS. 5 and 6, the circulating liquid chamber 65 and the pressure chamber C do not overlap each other in a plan view. In addition, since the piezoelectric element 44 is formed over the entire pressure chamber C along the X direction, the circulation channel 72 and the piezoelectric element 44 overlap each other in a plan view, but the circulating liquid chamber 65 and the piezoelectric element 44 do not overlap each other in a plan view. As understood from the description provided above, the pressure chamber C or the piezoelectric element 44 overlaps the circulation channel 72 in a plan view but does not overlap the circulating liquid chamber 65 in a plan view. Hence, an advantage is achieved in that it is easier to decrease the liquid ejecting head 26 in size than in a configuration in which the pressure chamber C or the piezoelectric element 44 does not overlap the circulation channel 72 in a plan view, for example.

As described above, in the first embodiment, the circulation channel 72 through which the communication channel 63 and the circulating liquid chamber 65 communicate with each other is formed in the nozzle plate 52. Hence, compared with a configuration in PTL 1 in which a circulating communication channel is formed in a communication plate, it is possible to more efficiently circulate the ink in the vicinity of the nozzle N to the circulating liquid chamber 65. In addition, in the first embodiment, the communication channels 63 corresponding to the first array L1 and the communication channels 63 corresponding to the second array L2 commonly communicate with the circulating liquid chamber 65 between both the communication channels. Hence, an advantage is achieved in that a configuration of the liquid ejecting head 26 is more simplified (therefore, miniaturization is realized) than in a configuration in which a circulating liquid chamber communicating with the circulation channels 72 corresponding to the first array L1 is separately provided from a circulating liquid chamber communicating with the circulation channels 72 corresponding to the second array L2.

Second Embodiment

A second embodiment of the present invention is described. Elements having the same operations or functions in aspects, which will be exemplified below, as those in the first embodiment are assigned with the same reference signs used in the description of the first embodiment, and thus the detailed descriptions thereof are appropriately omitted.

Figure 7:
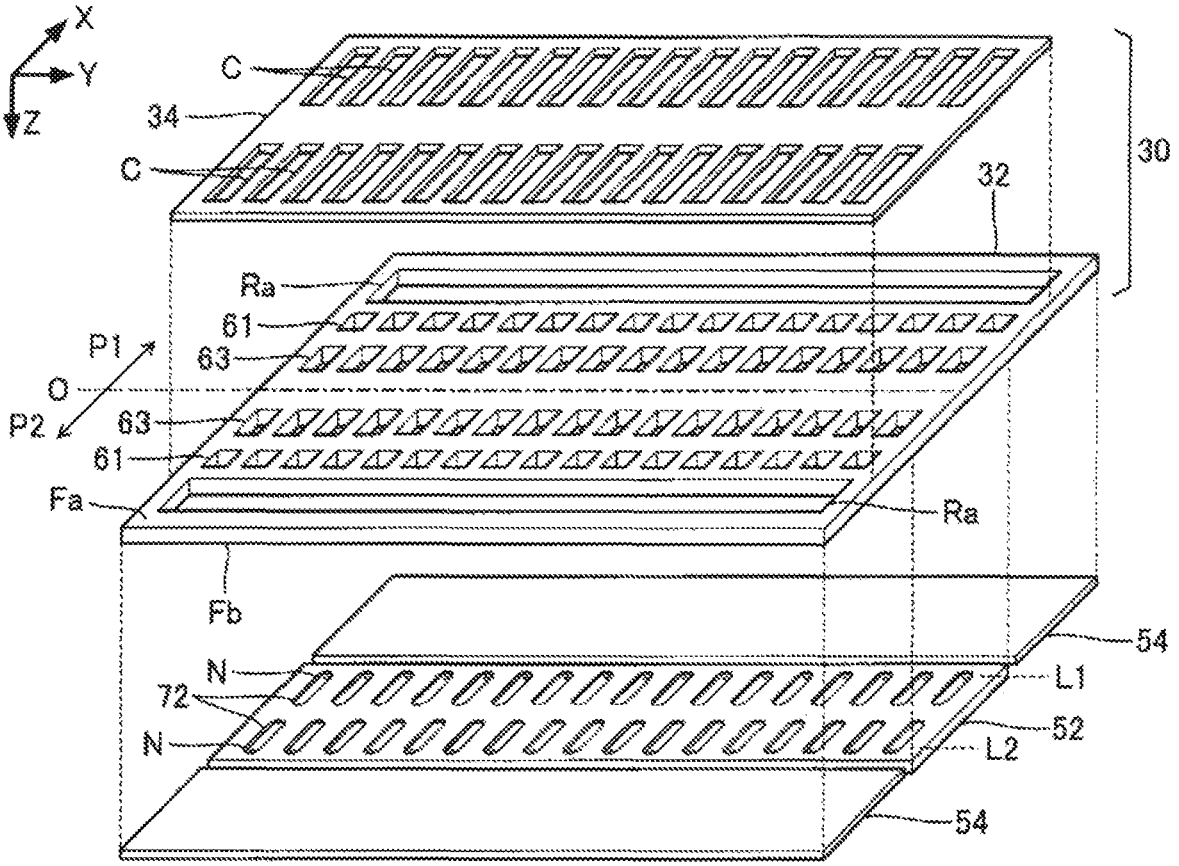
FIG. 7 is a partially exploded perspective view of a liquid ejecting head according to a second embodiment.
Figure 8:
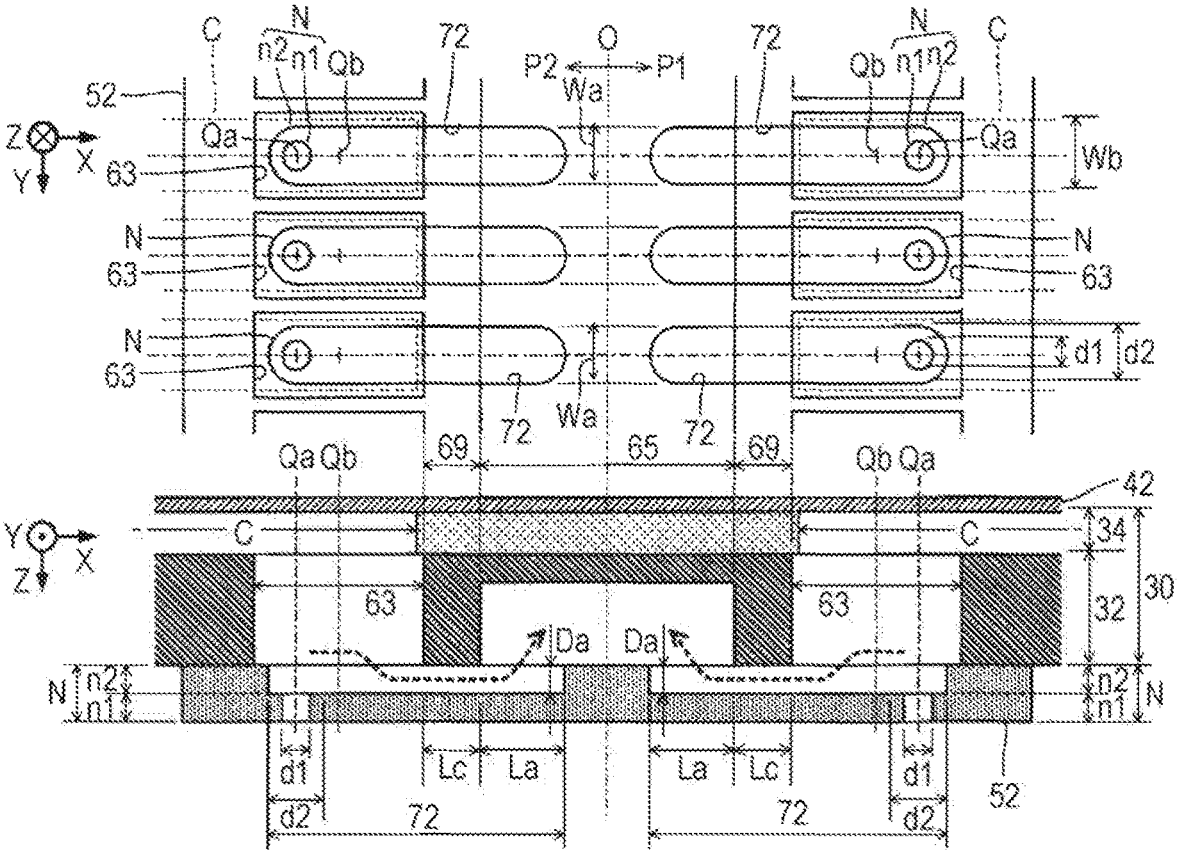
FIG. 8 shows a plan view and a sectional view in the vicinity of a circulating liquid chamber according to the second embodiment.

FIG. 7 is a partially exploded perspective view of the liquid ejecting head 26 according to the second embodiment and corresponds to FIG. 3 referred to in first embodiment. In addition, FIG. 8 shows an enlarged plan view and an enlarged sectional view of a portion in the vicinity of the circulating liquid chamber 65 of the liquid ejecting head 26 and corresponds to FIG. 6 referred to in the first embodiment.

In the first embodiment, a configuration in which the circulation channel 72 and the nozzle N are separated from each other is exemplified. In the second embodiment, as understood from FIGS. 7 and 8, the circulation channel 72 and the nozzle N are continuous to each other. In other words, one circulation channel 72 in the first portion P1 is continuous to one nozzle N of the first array L1, one circulation channel 72 in the second portion P2 is continuous to one nozzle N of the second array L2. Specifically, as illustrated in FIG. 8, the second zones n2 of the nozzles N are continuous to the circulation channels 72, respectively. In other words, the circulation channel 72 and the second zone n2 are formed to have the same depth as each other, and an inner peripheral surface of the circulation channel 72 and an inner peripheral surface of the second zone n2 are continuous to each other. In other words, it is possible to employ a configuration in which the nozzle N (first zone n1) is formed on the bottom surface of one circulation channel 72 extending in the X direction. Specifically, the first zone n1 of the nozzle N is formed in the vicinity of an end portion of the bottom surface of the circulation channel 72 on the opposite side of the center plane O. The other configurations are the same as those of the first embodiment. For example, also in the second embodiment, the flow channel length La of a portion of the circulation channel 72, which overlaps the circulating liquid chamber 65 is longer than a flow channel length Lc of a portion of the circulation channel 72, which overlaps the partition wall 69 of the flow channel forming unit 30 (La>Lc).

Also in the second embodiment, the same effects as those of the first embodiment are realized. In addition, in the second embodiment, the second zones n2 of the nozzles N and the circulation channels 72 are continuous to each other. Hence, compared with the configuration of the first embodiment in which the circulation channel 72 and the nozzle N are separated from each other, an effect is particularly remarkable in that it is possible to efficiently circulate the ink in the vicinity of the nozzle N to the circulating liquid chamber 65.

Third Embodiment

Figure 9:
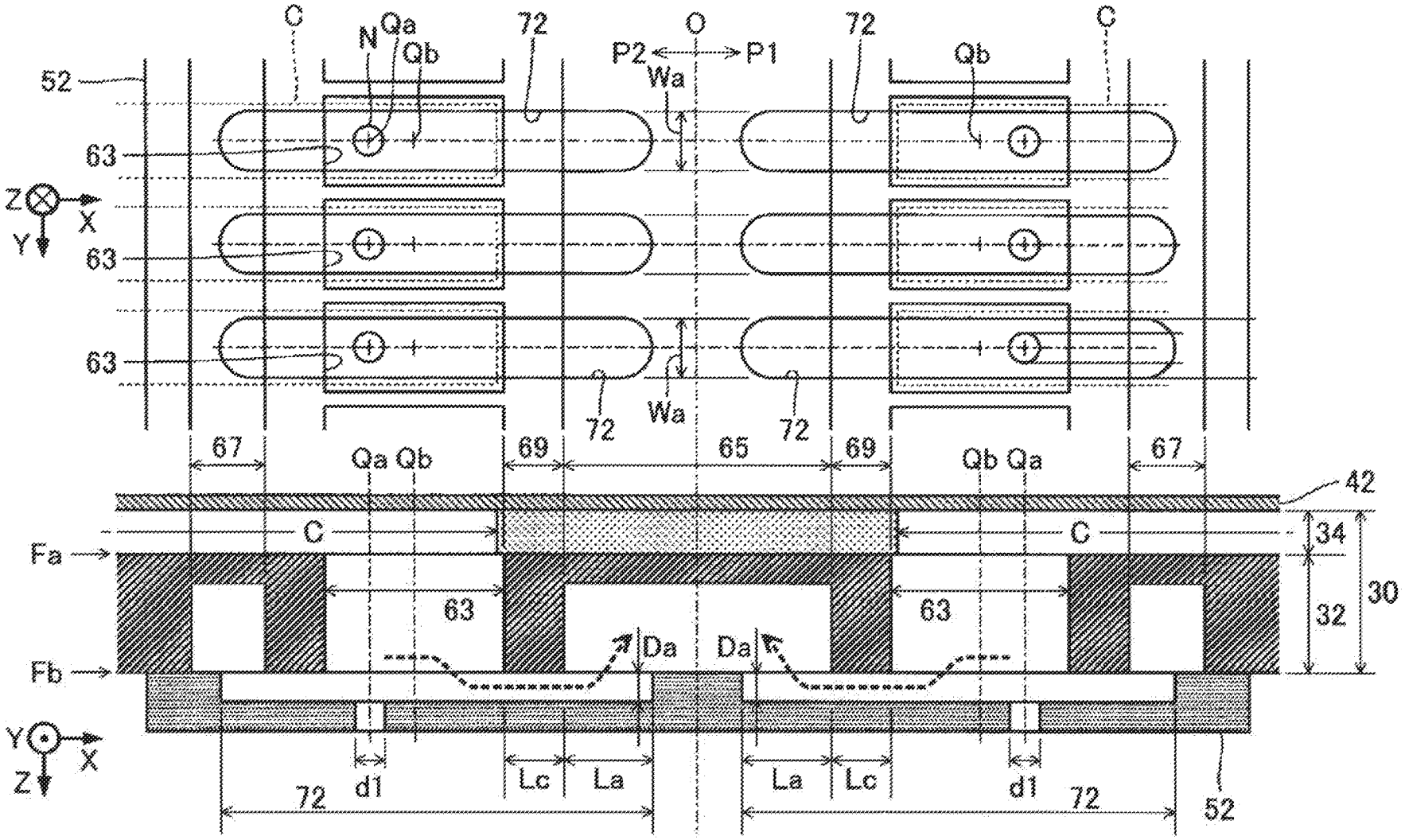
FIG. 9 shows a plan view and a sectional view in the vicinity of a circulating liquid chamber according to a third embodiment.

FIG. 9 shows an enlarged plan view and an enlarged sectional view of a portion in the vicinity of the circulating liquid chamber 65 of the liquid ejecting head 26 according to a third embodiment. As illustrated in FIG. 9, a circulating liquid chamber 67 corresponding to each of the first portion P1 and the second portion P2 is formed, in addition to the same circulating liquid chamber 65 as that in the first embodiment described above, on the front surface Fb of the first flow channel substrate 32 in the third embodiment. The circulating liquid chamber 67 is a bottomed hole (groove) having an elongated shape which is formed on the opposite side of the circulating liquid chamber 65 with the communication channel 63 and the nozzle N interposed therebetween and extends in the Y direction. The nozzle plate 52 joined to the front surface Fb of the first flow channel substrate 32 blocks an opening of each of the circulating Liquid chamber 65 and the circulating liquid chamber 67.

The circulation channel 72 of the third embodiment is a groove that extends in the K direction over the circulating liquid chamber 65 and the circulating liquid chamber 67 in each of the first portion P1 and the second portion P2. Specifically, an end portion of the circulation channel 72 on the side (side of the circulating liquid chamber 65) of the center plane O overlaps the circulating liquid chamber 65 in a plan view, and an end portion of the circulation channel 72 on the opposite side (side of the circulating liquid chamber 67) of the center plane O overlaps the circulating liquid chamber 67 in a plan view. In addition, the circulation channel 72 overlaps the communication channel 63 in a plan view. In other words, the communication channels 63 communicate with both the circulating liquid chamber 65 and the circulating liquid chamber 67 via the circulation channels 72.

In other words, the nozzle N (first zone n1) is formed on the bottom surface of the circulation channel 72. Specifically, the first zone n1 of the nozzle N is formed on the bottom surface of a portion of the circulation channel 72, which overlaps the communication channel 63 in a plan view. Similarly to the second embodiment, also in the third embodiment, it is possible to realize a configuration in which the circulation channel 72 and the nozzle N (second zone n2) are continuous to each other. As understood from the description provided above, the communication channel 63 and the nozzle N are positioned on the end portion of the circulation channel 72 in the first and second embodiments, and the communication channel 63 and the nozzle N are positioned in an intermediate portion of the circulation channel 72 extending in the X direction in the third embodiment.

As understood from the description provided above, in the third embodiment, when the pressure in the pressure chamber C changes in the pressure chamber C, a part of ink flowing in the communication channel 63 is elected outside from the nozzle N, and a part of the rest ink is supplied to both the circulating liquid chamber 65 and the circulating liquid chamber 67 from the communication channel 63 through the circulation channel 72. The ink in the circulating liquid chamber 67 and the ink in the circulating liquid chamber 65 are together suctioned by the circulation mechanism 75. Then, after bubbles or foreign matter is removed by the circulation mechanism 75, and thickening is lowered, the ink is supplied to the liquid reservoir R.

Also in the third embodiment, the same effects as those of the first embodiment are realized. In addition, in the third embodiment, in addition to the circulating liquid chamber 65, the circulating liquid chamber 67 is formed, and thus an advantage is achieved in that it is possible to ensure sufficient circulation amount more than in the first embodiment. FIG. 9 illustrates a configuration in which the circulation channel 72 and the nozzle N are continuous to each other similarly to the second embodiment; however, in the third embodiment, it is possible to separate the circulation channel 72 and the nozzle N from each other similarly to the first embodiment.

Modification Examples

The embodiments described above can be modified in various ways. Specific modification examples that can be applied to the embodiments described above are described as follows. Two or more examples optionally selected from below can be appropriately combined within a range in which the examples are compatible with each other.

Figure 10:
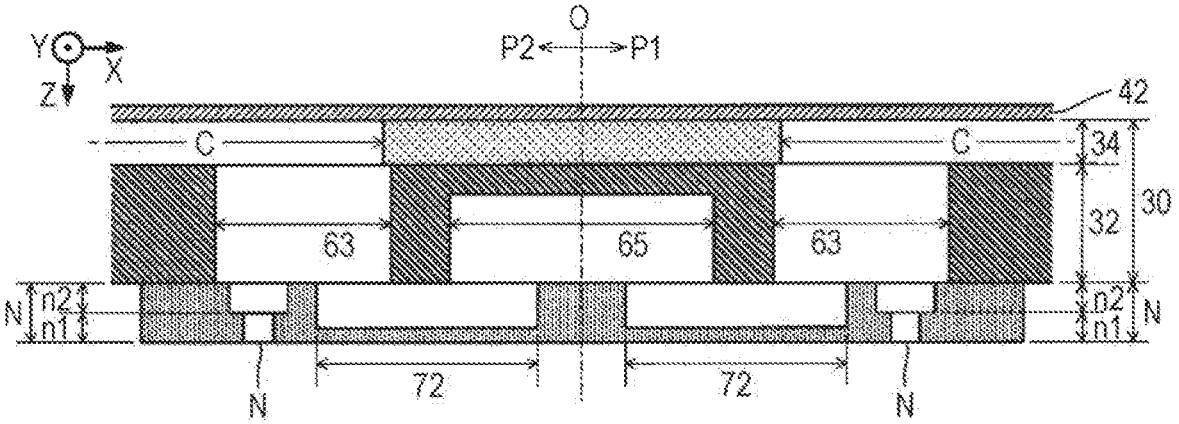
FIG. 10 shows a sectional view in the vicinity of a circulating liquid chamber in a liquid ejecting head according to a modification example.
Figure 11:
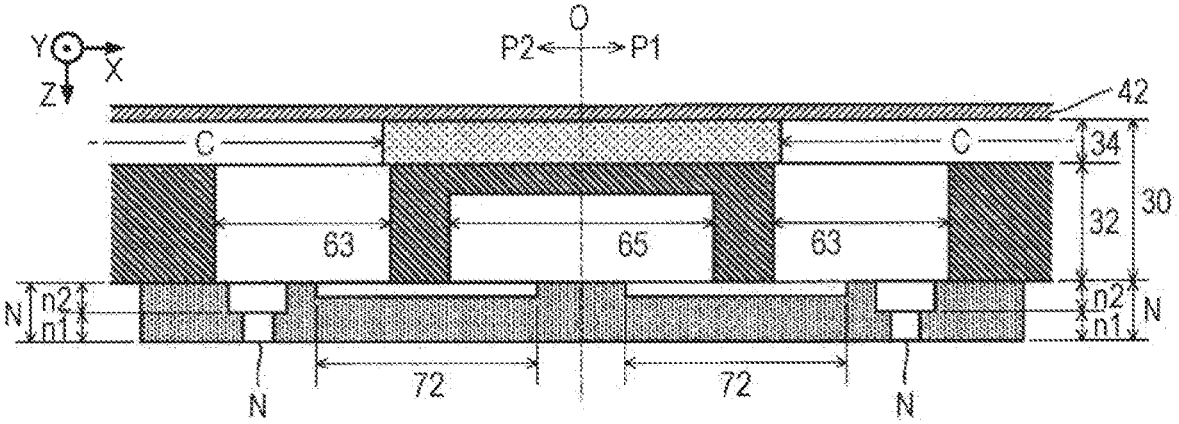
FIG. 11 shows a sectional view in the vicinity of a circulating liquid chamber in a liquid ejecting head according to another modification example.

(1) In the embodiments described above, the configuration in which the circulation channel 72 and the second zone n2 of the nozzle N have the same depth is exemplified; however, a relationship between the depth of the circulation channel 72 and the depth of the second zone n2 is not limited to that described above. For example, it is possible to employ a configuration in which the circulation channel 72 deeper than the second zone n2 is formed as illustrated in FIG. 10 or a configuration in which the circulation channel 72 shallower than the second zone n2 is formed as illustrated in FIG. 11. According to the configuration in FIG. 10, the flow channel resistance of the circulation channel 72 is lower than that in the configuration in FIG. 11, and thus it is possible to more increase the circulation amount than in the configuration in FIG. 11. On the other hand, according to the configuration in FIG. 11, the flow channel resistance of the circulation channel 72 is higher than that in the configuration in FIG. 10, and thus it is possible to more increase the ejection amount than in the configuration in FIG. 10.

Figure 12:
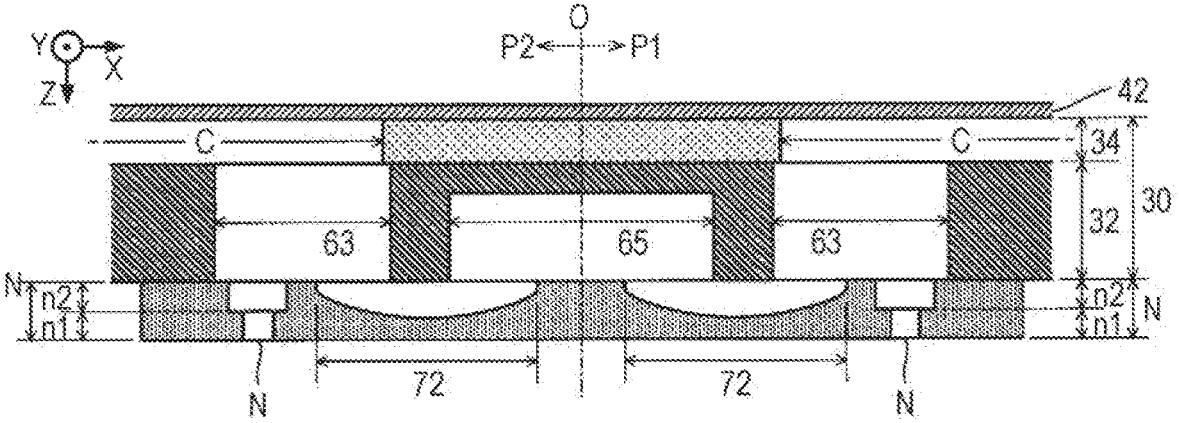
FIG. 12 shows a sectional view in the vicinity of a circulating liquid chamber in a liquid ejecting head according to still another modification example.

(2) In the embodiments described above, the configuration in which the depth Da of the circulation channel 72 is constant is exemplified; however, it is possible to change the depth of the circulation channel 72 depending on a position in the X direction. For example, as illustrated in FIG. 12, a configuration in which an intermediate portion (for example, a portion that overlaps the partition wall 69 in a plan view) of the circulation channel 72 is deeper than a portion on the side of the circulating liquid chamber 65 and a portion on the side of the nozzle N when viewed from the intermediate portion is assumed. According to the configuration in FIG. 12, the flow channel resistance of the circulation channel 72 is lower than that in the configuration in which the depth Da of the circulation channel 72 is constant over the entire length. Hence, an advantage is achieved in that it is easy to ensure the circulation amount.

(3) In the embodiments described above, the configuration in which the flow channel width Wa of the circulation channel 72 is equal to the maximum diameter of the nozzle N (the inner diameter d2 of the second zone n2) is exemplified; however, the flow channel width Wa is not limited to that described above. For example, it is also possible to employ a configuration in which the flow channel width Wa of the circulation channel 72 is smaller than the maximum diameter of the nozzle N (the inner diameter d2 of the second zone n2). According to the configuration described above, the flow channel resistance of the circulation channel 72 is higher than that in the configuration in which the circulation channel 72 is larger than the maximum diameter of the nozzle N. Hence, it is possible to increase the ejection amount. In addition, it is also possible to employ a configuration in which the flow channel width Wa of the circulation channel 72 is larger than the inner diameter d1 of the first zone n1). According to the configuration described above, ensuring of the circulation amount is compatible with ensuring of the ejection amount.

Figure 13:
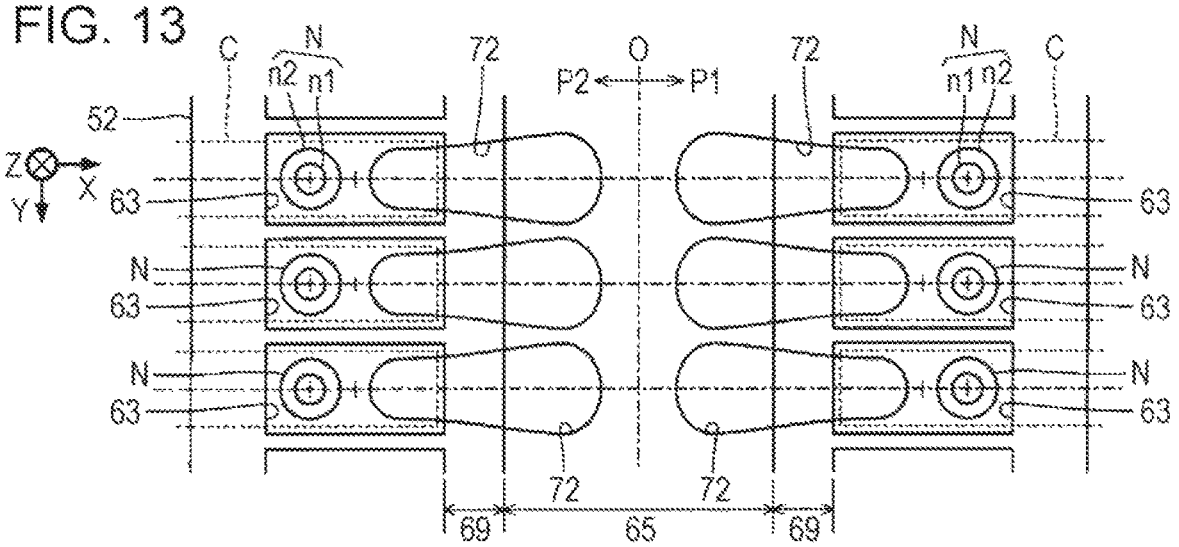
FIG. 13 shows a plan view in the vicinity of a circulating liquid chamber in a liquid electing head according to still another modification example.

(4) In the embodiments described above, the configuration in which the flow channel width Wa of the circulation channel 72 is constant is formed; however, it is possible to change the flow channel width of the circulation channel 72 depending on a position in the X direction. For example, as illustrated in FIG. 13, it is possible to employ a configuration in which a flow channel width of a portion of the circulation channel 72 on the side of the circulating liquid chamber 65 is wider than a flow channel width thereof on the side of the nozzle N. Specifically, the circulation channel 72 is formed to have a planar shape in which the flow channel width of the circulation channel 72 monotonically increases from an end portion thereof on the side of the nozzle to an end portion thereof on the side of the circulating liquid chamber 65. According to a configuration in FIG. 13, ink easily flows through the circulation channel 72 from the communication channel 63 toward the circulating liquid chamber 65. Hence, an advantage is achieved in that it is easy to ensure the circulation amount.

Figure 14:
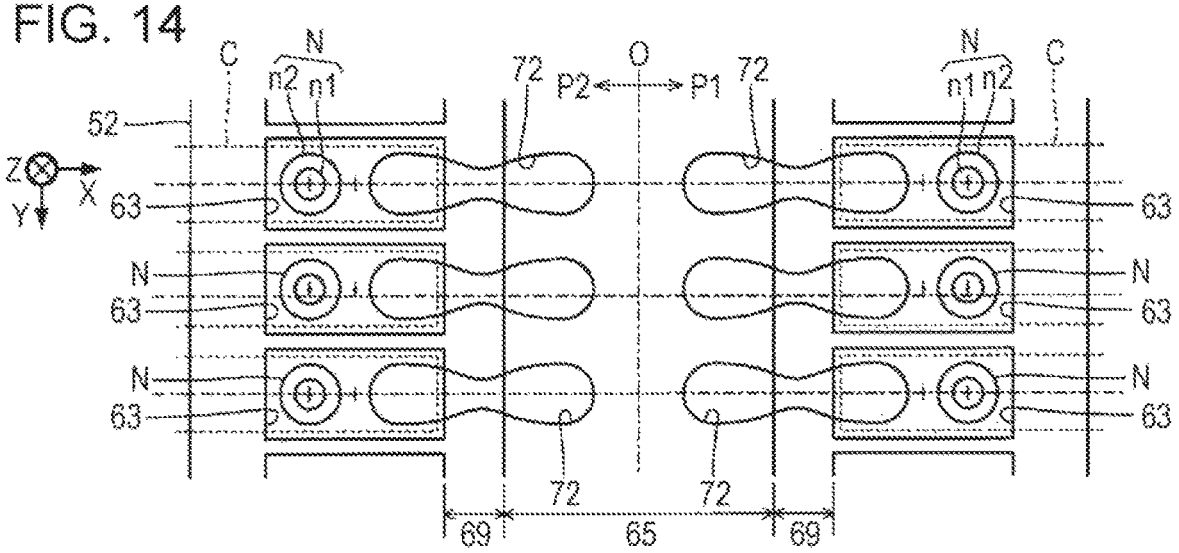
FIG. 14 shows a plan view in the vicinity of a circulating liquid chamber in a liquid ejecting head according to still another modification example.

In addition, as illustrated in FIG. 14, it is also possible to employ a configuration in which a flow channel width in the intermediate portion (for example, the portion that overlaps the partition wall 69 in a plan view) of the circulation channel 72 is narrower than a flow channel width or a portion on the side of the circulating liquid chamber 65 and a flow channel width of a portion on the side of the nozzle N when viewed from the intermediate portion. In other words, the flow channel width monotonically decreases from both end portions toward the intermediate portion of the circulation channel 72 such that a portion (for example, the portion that overlaps the partition wall 69 in a plan view) on the circulation channel 72 has the minimum flow channel width. According to the configuration in FIG. 14, the flow channel resistance of the circulation channel 72 is higher than that in the configuration in which the flow channel width of the circulation channel 72 is constant. Hence, it is possible to increase the ejection amount.

Figure 15:
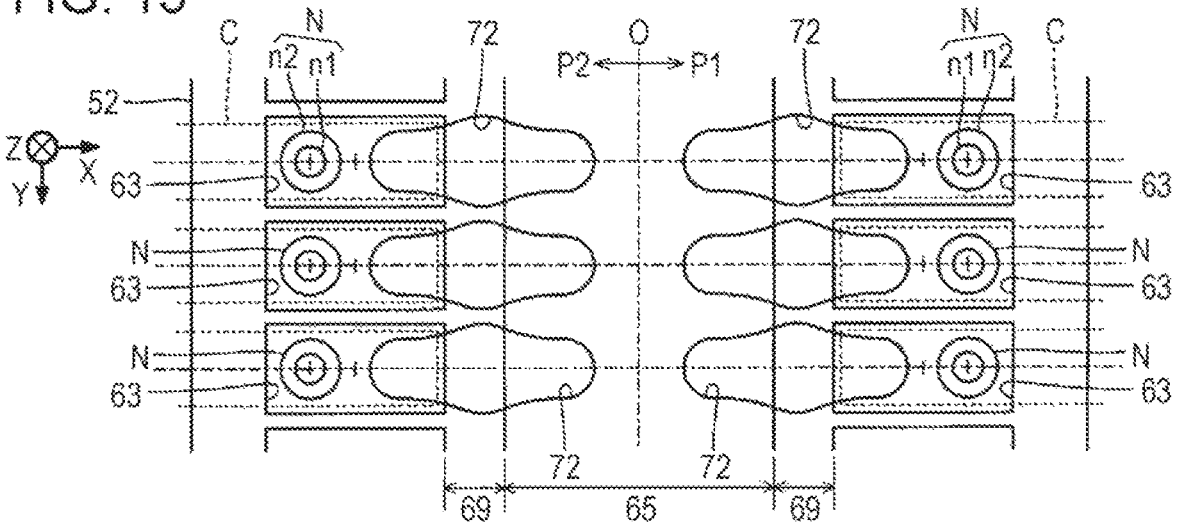
FIG. 15 shows a plan view in the vicinity of a circulating liquid chamber in a liquid ejecting head according to still another modification example.

As illustrated in FIG. 15, it is also possible to employ a configuration in which the flow channel width in the intermediate portion (for example, the portion that overlaps the partition wall 69 in a plan view) of the circulation channel 72 is wider than the flow channel width of the portion on the side of the circulating liquid chamber 65 and the flow channel width of the portion on the side of the nozzle N when viewed from the intermediate portion. In other words, the flow channel width monotonically increases from both end portions toward the intermediate portion of the circulation channel 72 such that a portion (for example, the portion that overlaps the partition wall 69 in a plan view) on the circulation channel 72 has the maximum flow channel width. According to the configuration in FIG. 15, the flow channel resistance of the circulation channel 72 is lower than that in the configuration in which the flow channel width of the circulation channel 72 is constant. Hence, it is possible to increase the circulation amount.

It is necessary to form the thick partition wall 69 in order to ensure the mechanical strength of the partition wall 69 of the first flow channel substrate 32. However, the thicker the partition wall 69 (the longer the flow channel length Lc) is, the more the flow channel resistance of the circulation channel 72 increases. According to a configuration in FIG. 15, even in a case where the thickness of the partition wall 69 is ensured to the extent that sufficient strength is realized, an advantage is achieved in that the intermediate portion of the circulation channel 72 becomes wider, and thereby it is possible to decrease the flow-path resistance of the circulation channel 72. In other words, ensuring of the strength of the partition wall 69 can be compatible with the reduction in flow channel resistance of the circulation channel 72.

Figure 16:
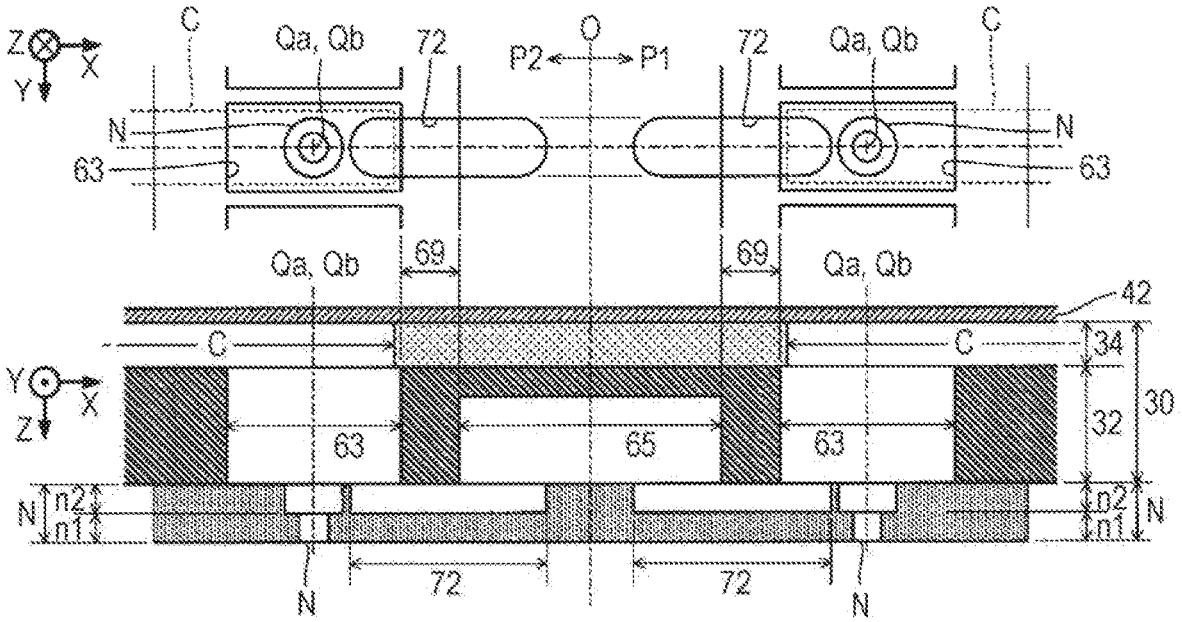
FIG. 16 shows a plan view and a sectional view in the vicinity of a circulating liquid chamber of liquid ejecting head according to still another modification example.

(5) In the embodiments described above, the configuration in which the center axis Qa of the nozzle N is positioned on the opposite side of the circulating liquid chamber 65 when viewed from the center axis Qb of the communication channel 63 is exemplified; however, a relationship between the center axis Qa of the nozzle N and the center axis Qb of the communication channel 63 is not limited to that described above. For example, as illustrated in FIG. 16, the center axis Qa of the nozzles N can be positioned at the same position as the center axis Qb of the communication channels 63. According to a configuration in FIG. 16, an advantage is achieved in that the ensuring of the ejection amount is more easily compatible with the ensuring of the circulation amount than in a configuration in which the center axis Ca and the center axis Qb are positioned at different locations from each other.

Figure 17:
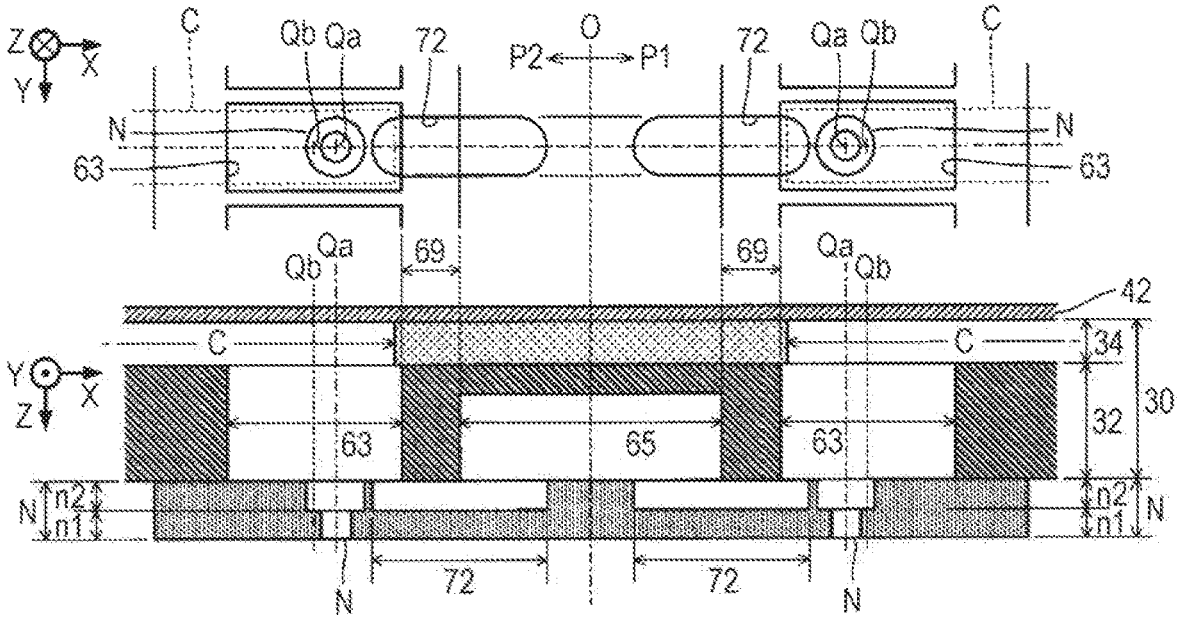
FIG. 17 shows a plan view and a sectional view in the vicinity of a circulating liquid chamber of a liquid ejecting head according to still another modification example.

In addition, as illustrated in FIG. 17, it is possible to employ a configuration in which the center axis Qa of the nozzles N is positioned on the side (side of center plane O) of the circulating liquid chamber 65 when viewed from the center axis Qb of the communication channels 63. According to a configuration in FIG. 17, it is possible to increase the circulation amount and decrease the election amount more than in the configuration (for example, the first embodiment) in which the center axis Qa of the nozzle N is positioned on the opposite side of the circulating liquid chamber 65 when viewed from the center axis Qb of the communication channel 63. On the other hand, according to the configuration in which the center axis Qa of the nozzle N positioned on the opposite side of the circulating liquid chamber 65 when viewed from the center axis Qb of the communication channel 63 as in the embodiments described above, it is possible to decrease the circulation amount and increase the ejection amount more than in the configuration in FIG. 17.

Figure 18:
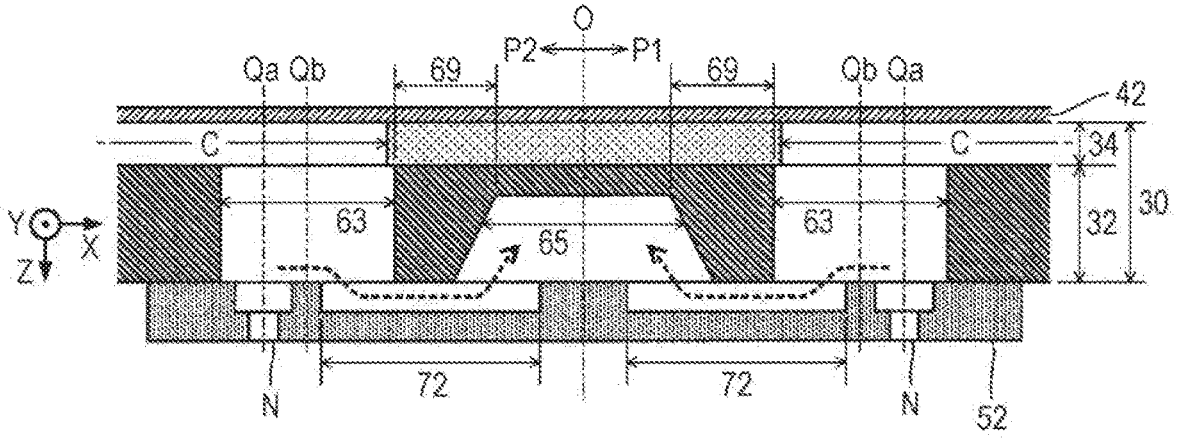
FIG. 18 shows a sectional view in the vicinity of a circulating liquid chamber in a liquid ejecting head according to still another modification example.

(6) In the embodiments described above, the circulating liquid chamber 65 having a shape demarcated by a side surface parallel to the Y-Z plane and the upper surface (ceiling surface) parallel to the X-Y plane is exemplified; however, the shape of the circulating liquid chamber 65 is not limited to that exemplified above. For example, as illustrated in FIG. 18, the circulating liquid chamber 65 having a shape in which a side surface is inclined with respect to the upper surface parallel to the X-Y plane can be formed in the first flow channel substrate 32. Specifically, the side surface of the circulating liquid chamber 65 is inclined with respect to the upper surface such that the flow channel width (dimension in the X direction) of the circulating liquid chamber 65 increases toward a position on the positive side in the Z direction.

According to a configuration in FIG. 18, since the partition wall 69 is formed to be thicker than in the configurations of the embodiments described above in which the side surface of the circulating liquid chamber 65 is parallel to the Y-Z plane, an advantage is achieved is that it is possible to sufficiently ensure the mechanical strength of the partition wall 69. With consideration for pressing of the first flow channel substrate 32 in the Z direction during mounting of the wiring substrate 28, the configuration in FIG. 18 in which it is possible to ensure the mechanical strength of the partition wall 69 is effective from the viewpoint of preventing the first flow channel substrate 32 from being broken or the like. In addition, according to the configuration in which the side surface of the circulating liquid chamber 65 is inclined as illustrated in FIG. 18, an advantage is also achieved in that the ink easily flows the circulating liquid chamber 65. The following description is provided by focusing on the circulating liquid chamber 65; however, likewise for the circulating liquid chamber 67 exemplified in the third embodiment, it is possible to employ the shape in which the side surface is inclined with respect to the upper surface parallel to the X-Y. In FIG. 18, the flow channel length Lc of a portion of the circulation channel 72, which overlaps the partition wall 69 of the flow channel forming unit 30 is a length of a portion of the circulation channel 72, which overlaps the front surface Fb of the partition wall 69.

Figure 19:
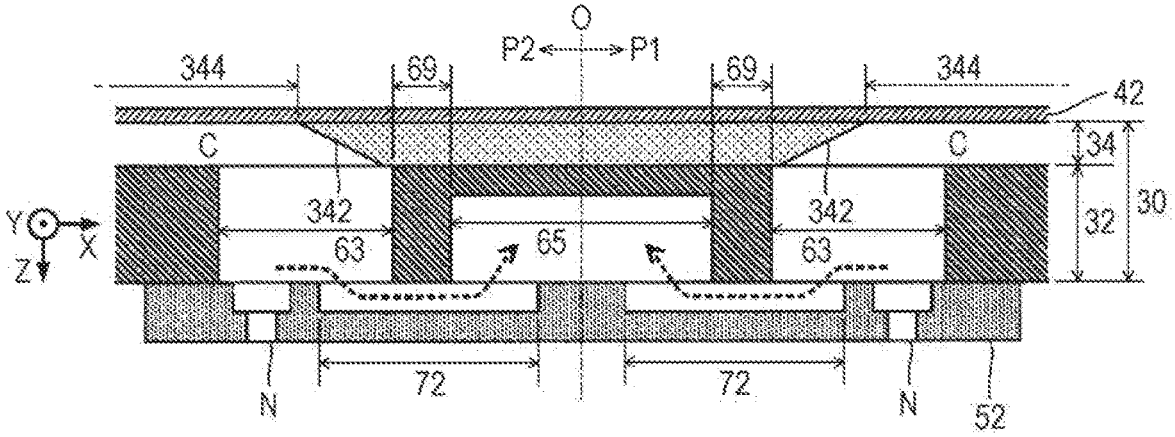
FIG. 19 shows a sectional view in the vicinity of a circulating liquid chamber in a liquid ejecting head according to still another modification example.

(7) As illustrated in FIG. 19, it is preferable to employ a configuration in which an end surface of the pressure chamber C on the side of the communication channel 63 (the side of the center plane O) is configured of an inclined surface 342 inclined with respect to the upper surface of the pressure chamber C (the upper surface of the vibrating unit 42). As understood from FIG. 19, a region (region that is not covered with the inclined surface 342) 344 of the vibrating unit 42, which is exposed from the second flow channel substrate 34, does not overlap the circulation channel 72 in a plan view. The region 344 in FIG. 19 configures the upper surface (ceiling surface) of the pressure chamber C.

Figure 20:
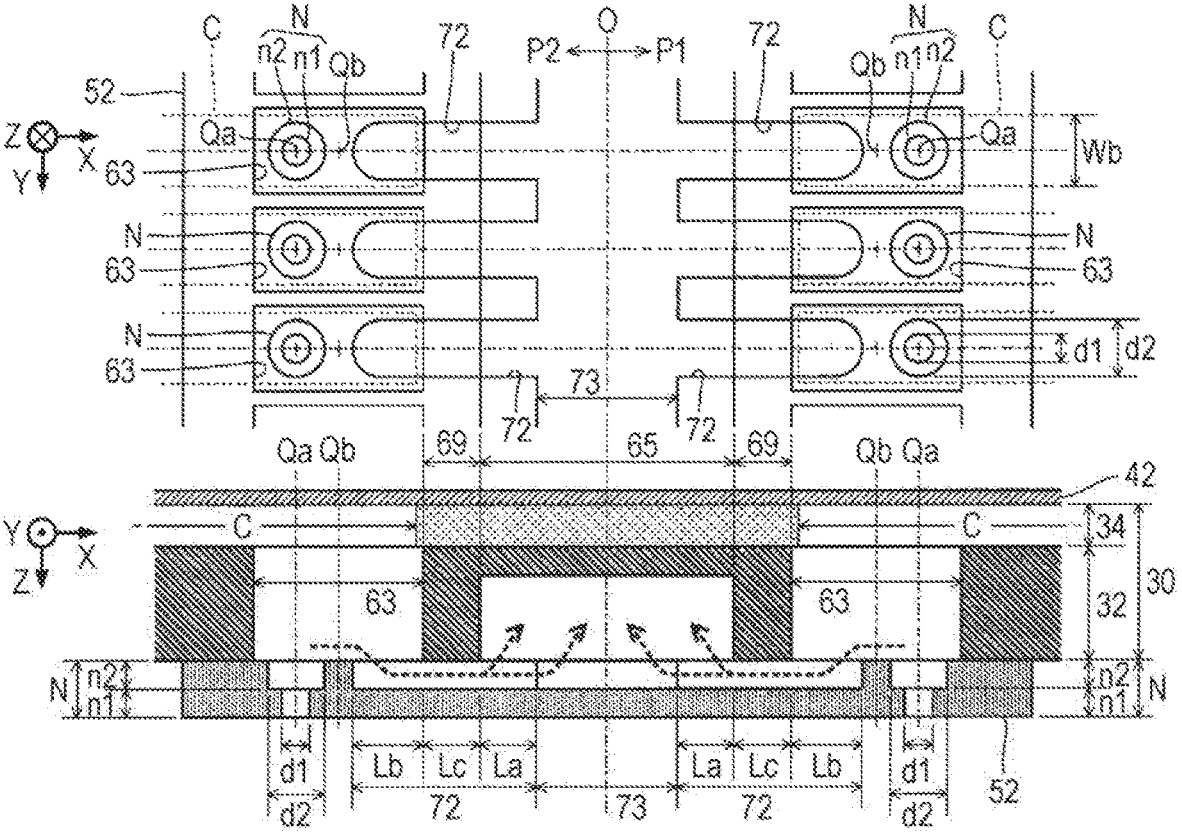
FIG. 20 shows a plan view and a sectional view in the vicinity of a circulating liquid chamber of a liquid electing head according to still another modification example.

(9) As illustrated in FIG. 20, a flow channel (hereinafter, referred to as a "common circulation channel") 73 that is continuous to the circulation channel 72 (first circulation channel) of the first portion P1 and the circulation channel 72 (second circulation channel) of the second portion P2 can be formed in the nozzle plate 52. The common circulation channel 73 is a cavity formed on a front surface in the nozzle plate 52, the front surface being opposite to the flow channel forming unit 30. The common circulation channel 73 is formed to have the same depth as that of the circulation channels 72. The common circulation channel 73 illustrated in FIG. 20 extends in the Y direction so as to overlap the circulating liquid chamber 65 in a plan view (specifically, a peripheral edge of the common circulation channel 73 is surrounded by a peripheral edge of the circulating liquid chamber 65). A width (dimension in the X direction) of the common circulation channel 73 is narrower than a width (dimension in the X direction) of the circulating liquid chamber 65.

As illustrated in FIG. 20, end portions of the plurality of circulation channels 72 of the first portion P1 on the negative side in the X direction are continuous to the peripheral edge of the common circulation channel 73 on the positive side in the X direction. Similarly, end portions of the plurality of circulation channels 72 of the second portion P2 on the positive side in the X direction are continuous to the peripheral edge of the co on circulation channel 73 on the negative side in the X direction. In other words, the common circulation channel 73 is formed between the arrangement of the plurality of circulation channels 72 in the first portion P1 and the arrangement of the plurality of circulation channels 72 in the second portion P2. In other words, the plurality of circulation channels 72 of the first portion P1 extend on the positive side in the X direction from the peripheral edge of the common circulation channel 73 on the positive side in the X direction, and the plurality of circulation channels 72 of the second portion P2 extend on the negative side in the X direction from the peripheral edge of the common circulation channel 73 on the negative side in the X direction.

In the aspect described above, according to a configuration in FIG. 20 in which the common circulation channel 73 is formed in the nozzle plate 52, it is possible to more increase a flow channel area (hence, decrease the flow channel resistance) of ink that is supplied from the circulation channel 72 to the circulating liquid chamber 65 than in a configuration (for example, the embodiments described above) in which the common circulation channel 73 is not formed. The configuration in which the common circulation channel 73 is formed in the nozzle plate 52 is similarly applied to any embodiment (first to third embodiments and modification examples) described above.

(9) In the embodiments described above, the configuration in which the elements related to the first array L1 are disposed in plane symmetry with the elements related to the second array L2 with the center plane O interposed therebetween is exemplified; however, there is no need to employ the plane-symmetrical configuration. For example, it is also possible to employ a configuration in which the elements corresponding only to the first array L1 are arranged in the same manner as in the embodiments described above. In addition, in the embodiments described above, the configuration in which the circulation channel 72 is formed in the nozzle plate 52 is exemplified; however, the flow channels, through which the communication channels 63 and the circulating liquid chamber 65 communicate with each other, can be formed the flow channel forming unit 30 (for example, the front surface Fb of the first flow channel substrate 32).

(10) An element (pressure generating unit) that applies the pressure to the inside of the pressure chamber C is not limited to the piezoelectric element 44 exemplified in the embodiments described above. For example, it is also possible to use, as the pressure generating unit, a heating element that generates bubbles inside the pressure chamber C through heating and changes the pressure. The heating element is a portion (specifically, a region that generates bubbles in the pressure chamber C) in which a heating body is heated by supply of a drive signal. As understood from the description provided above, the pressure generating unit is collectively referred to as an element that ejects, from the nozzle N, a liquid in the pressure chamber C (typically, an element that applies pressure to the inside of the pressure chamber C), regardless of an operation method (piezoelectric method/heading method) or a specific configuration.

(11) In the embodiments described above, a serial type liquid ejecting apparatus 100 in which the transport member 242, on which the liquid electing head 26 is mounted, reciprocates is exemplified; however, the present invention can be applied to a line type liquid ejecting apparatus in which the plurality of nozzles N are arranged over the entire width of the medium 12.

(12) The liquid ejecting apparatus 100 exemplified in the embodiments described above can be employed in various types of machines such as a facsimile machine or a copy machine, in addition to a machine dedicated to printing. However, the use of the liquid ejecting apparatus of the present invention is not limited to the printing. For example, a liquid ejecting apparatus that ejects a solution of a color material is used as a manufacturing apparatus that forms a color filter of a liquid crystal display device. In addition, a liquid ejecting apparatus that ejects a solution of a conductive material is used as a manufacturing apparatus that forms a wiring or an electrode of the wiring substrate.

REFERENCE SIGNS LIST

100 LIQUID EJECTING APPARATUS
12 MEDIUM
14 LIQUID CONTAINER
20 CONTROL UNIT
22 TRANSPORT MECHANISM
24 MOVING MECHANISM
242 TRANSPORT MEMBER
244 TRANSPORT BELT
26 LIQUID EJECTING HEAD
28 WIRING SUBSTRATE
30 FLOW CHANNEL FORMING UNIT
32 FIRST FLOW CHANNEL SUBSTRATE
34 SECOND FLOW CHANNEL SUBSTRATE
42 VIBRATING UNIT
44 PIEZOELECTRIC ELEMENT
46 PROTECTIVE MEMBER

48 HOUSING
482 INTRODUCTION PORT
52 NOZZLE PLATE
54 VIBRATION ABSORBER
61 SUPPLY CHANNEL
63 COMMUNICATION CHANNEL
65, 67 CIRCULATING LIQUID CHAMBER
67 CIRCULATING LIQUID CHAMBER
69 PARTITION WALL
n1 FIRST ZONE
n2 SECOND ZONE
72 CIRCULATION CHANNEL
75 CIRCULATION MECHANISM

The invention claimed is:

1. A liquid ejecting head comprising:

a nozzle plate provided with a first nozzle and a second nozzle;

a flow channel forming unit provided with a first pressure chamber and a second pressure chamber to which a liquid is supplied, a first communication channel through which the first nozzle and the first pressure chamber communicate with each other, a second communication channel through which the second nozzle and the second pressure chamber communicate with each other, and a circulating liquid chamber that is positioned between the first communication channel and the second communication channel; and a pressure generating unit that generates a pressure change in each of the first pressure chamber and the second pressure chamber, wherein the nozzle plate has a first groove, a second groove and a first wall portion, the first groove being a first circulation channel through which the first communication channel and the circulating liquid chamber communicate with each other, the second groove being a second circulation channel through which the second communication channel and the circulating liquid chamber communicate with each other, and the first wall portion separating the first nozzle and the first groove, and wherein the first wall portion includes a first surface that forms a part of an outside wall of the first nozzle and a second surface that forms a part of an outside wall of the first groove.

2. The liquid ejecting head according to claim 1, wherein the first nozzle is provided with a first zone and a second zone that has a diameter larger than that of the first zone and that is positioned on a side of the flow channel forming unit when viewed from the first zone.

3. The liquid ejecting head according to claim 2, wherein the first circulation channel has the same depth as a depth of the second zone.

4. The liquid ejecting head according to claim 2, wherein the first circulation channel is deeper than the second zone.

5. The liquid ejecting head according to claim 2, wherein the first circulation channel is shallower than the second zone.

6. The liquid ejecting head according to claim 2, wherein the second zone is continuous to the first circulation channel.

7. The liquid ejecting head according to claim 1, wherein a flow channel length La of a portion of the first circulation channel, which overlaps the circulating liquid chamber in plan view, and a flow channel length Lb of a portion of the first circulation channel, which overlaps the first communication channel in plan view, satisfy La>Lb.

8. The liquid ejecting head according to claim 7, wherein a flow channel length Lc of a portion of the first circulation channel, which overlaps a partition wall, in plan view, between the first communication channel and the circulating liquid chamber in the flow channel forming unit satisfies La>Lb>Lc.

9. The liquid ejecting head according to claim 1, wherein a flow channel length La of a portion of the first circulation channel, which overlaps the circulating liquid chamber in plan view, and a flow channel length Lc of a portion of the first circulation channel, which overlaps a partition wall, in plan view, between the first communication channel and the circulating liquid chamber in the flow channel forming unit, satisfy La>Lc.

10. The liquid ejecting head according to claim 1, wherein a flow channel width of the first circulation channel is smaller than a maximum diameter of the first nozzle.

11. The liquid ejecting head according to claim 1, wherein the flow channel width of the first circulation channel is smaller than a flow channel width of the first pressure chamber.

12. The liquid ejecting head according to claim 1, wherein a flow channel width of a portion of the first circulation channel on a side of the circulating liquid chamber is wider than a flow channel width of a portion thereof on a side of the first nozzle.

13. The liquid ejecting head according to claim 1, wherein a flow channel width of an intermediate portion of the first circulation channel is narrower than the flow channel width of the portion thereof on the side of the circulating liquid chamber and the flow channel width of the portion thereof on the side of the first nozzle when viewed from the intermediate portion.

14. The liquid ejecting head according to claim 1, wherein a flow channel width of an intermediate portion of the first circulation channel is wider than the flow channel width of the portion thereof on the side of the circulating liquid chamber and the flow channel width of the portion thereof on the side of the first nozzle when viewed from the intermediate portion.

15. The liquid ejecting head according to claim 1, wherein a center axis of the first nozzle is positioned on an opposite side of the circulating liquid chamber when viewed from the center axis of the first communication channel.

16. The liquid ejecting head according to claim 1, wherein a center axis of the first nozzle is positioned at the same location as the center axis of the first communication channel.

17. The liquid ejecting head according to claim 1, wherein a center axis of the first nozzle is positioned on the side of the circulating liquid chamber when viewed from the center axis of the first communication channel.

18. The liquid ejecting head according to claim 1, wherein an intermediate portion of the first circulation channel is deeper than the portion thereof on the side of the circulating liquid chamber and the portion thereof on the side of the first nozzle when viewed from the intermediate portion.

19. The liquid ejecting head according to claim 1, wherein, when a pressure change is generated in the first pressure chamber, an amount of the liquid that is supplied to the circulating liquid chamber via the first circulation channel is larger than an amount of the liquid that is ejected from the first nozzle.

20. The liquid ejecting head according to claim 1, wherein the first circulation channel and the circulating liquid chamber overlap each other in plan view, wherein the first circulation channel and the first pressure chamber overlap each other in plan view, and wherein the circulating liquid chamber and the first pressure chamber do not overlap each other in plan view.

21. The liquid ejecting head according to claim 1, wherein the first circulation channel and the circulating liquid chamber overlap each other in plan view, wherein the first circulation channel and the pressure generating unit overlap each other in plan view, and wherein the circulating liquid chamber and the pressure generating unit do not overlap each other in plan view.

22. A liquid ejecting apparatus comprising:

the liquid ejecting head according to claim 1.

23. The liquid ejecting head according to claim 1, wherein the nozzle plate has a second wall portion separating the second nozzle and the second groove.

24. The liquid ejecting head according to claim 23, wherein the nozzle plate has a third wall portion separating the first groove and the second groove.

25. The liquid ejecting head according to claim 1, wherein the first wall portion further includes a third surface that connect the first surface and the second surface directly.

26. The liquid ejecting head according to claim 25, wherein the third surface is a top face of the nozzle plate.

27. A liquid ejecting head comprising:

a nozzle plate provided with a first nozzle and a second nozzle;

a flow channel forming unit provided with a first pressure chamber to which a liquid is supplied, a first communication channel through which the first nozzle and the first pressure chamber communicate with each other, and a circulating liquid chamber; and a pressure generating unit that generates a pressure change of the first pressure chamber, wherein the nozzle plate has a first groove and a first wall portion, the first groove being a first circulation channel through which the first communication channel and the circulating liquid chamber communicate with each other, and the first wall portion separating the first nozzle and the first groove, and wherein the first wall portion includes a first surface that forms part of an outside wall of the first nozzle and a second surface that forms part of an outside wall of the first groove.

28. The liquid ejecting head according to claim 27, wherein the first nozzle is provided with a first zone and a second zone that has a diameter larger than that of the first zone and that is positioned on a side of the flow channel forming unit when viewed from the first zone.

29. The liquid ejecting head according to claim 27, wherein a flow channel length La of a portion of the first circulation channel, which overlaps the circulating liquid chamber in plan view, and a flow channel length Lb of a portion of the first circulation channel, which overlaps the first communication channel satisfy La>Lb.

* * * * *